United States Patent [19]

Hosono et al.

[11] Patent Number: 5,049,472

[45] Date of Patent: Sep. 17, 1991

[54] METHOD AND APPARATUS OF RECORDING IMAGE

[75] Inventors: Nagao Hosono, Hachioji; Yukio Nagase, Tokyo; Tatsuo Takeuchi, Kawasaki; Hiroshi Satomura, Hatogaya; Hidemi Egami, Zama; Yuji Sakemi, Yokohama; Yasushi Miura, Kawasaki, all of Japan

[73] Assignee: Canon Kabushiki Kaisha, Tokyo, Japan

[21] Appl. No.: 427,994

[22] Filed: Oct. 27, 1989

Related U.S. Application Data

[63] Continuation of Ser. No. 83,036, Aug. 7, 1987, abandoned.

[30] Foreign Application Priority Data

| | | | |
|---|---|---|---|
| Nov. 26, 1986 | [JP] | Japan | 61-282321 |
| Dec. 25, 1986 | [JP] | Japan | 61-313167 |
| Jan. 30, 1987 | [JP] | Japan | 62-19913 |
| Jun. 8, 1987 | [JP] | Japan | 62-141505 |

[51] Int. Cl.[5] ..... G03G 5/00

[52] U.S. Cl. ..... 430/200; 430/253; 430/346; 430/964; 250/318; 250/317.1; 503/201

[58] Field of Search ..... 430/253, 252, 200, 346, 430/964; 250/318, 317.1, 316.1; 427/55; 503/201

[56] References Cited

U.S. PATENT DOCUMENTS

| | | | |
|---|---|---|---|
| 2,740,896 | 4/1956 | Miller | 350/65 |
| 3,121,162 | 2/1964 | Roman et al. | 430/252 |
| 3,260,612 | 7/1966 | Dulmage et al. | 430/253 |
| 3,342,623 | 9/1967 | Dulmage et al. | 430/252 |
| 3,414,724 | 12/1968 | Kvarnegard | 250/318 |
| 3,908,125 | 9/1975 | Eichorn et al. | 250/316 |
| 3,996,397 | 12/1976 | Laridon et al. | 503/201 |
| 4,273,602 | 6/1981 | Kosaka et al. | 503/201 |
| 4,608,329 | 8/1986 | Geisler et al. | 430/110 |
| 4,716,291 | 12/1987 | Sakamoto et al. | 250/318 |

FOREIGN PATENT DOCUMENTS

| | | |
|---|---|---|
| 79442 | 6/1980 | Japan . |
| 127793 | 7/1984 | Japan . |
| 60-126632 | 4/1985 | Japan . |
| 1366253 | 7/1974 | United Kingdom . |

*Primary Examiner*—Charles L. Bowers, Jr.
*Assistant Examiner*—Mark R. Buscher
*Attorney, Agent, or Firm*—Fitzpatrick, Cella, Harper & Scinto

[57] ABSTRACT

A method of and an apparatus for recording an image on a recording medium. A heat-sensitive sheet having a light-transmissive base sheet provided with a heat-fusible supercooled substance layer is made to abut a copy original such that the heat-fusible supercooled substance layer faces the original image to be copied while flashlight is projected onto the base sheet of the heat-sensitive sheet. Thus, the image portion of the copy original to be copied absorbs the light transmitted through the heat-sensitive sheet and thereby generates heat so that an adhesive area containing a pattern corresponding to the original image is formed on the supercooled substance layer. After the heat-sensitive sheet has been removed from the copy original, such an adhesive area is transferred to the recording medium owing to the adhesiveness of the adhesive area.

9 Claims, 12 Drawing Sheets

METHOD AND APPARATUS OF RECORDING IMAGE

This application is a continuation of application Ser. No. 083,036, filed Aug. 7, 1987, now abandoned.

BACKGROUND OF THE INVENTION

1. Field of the Invention

The present invention relates to a method of recording an image on a recording medium and a recording apparatus suitable for carrying out the same.

2. Related Background Art

The recent trend of the copying machine market is towards compact and light-weight products designed for personal use.

In this situation, for example, Japanese Patent Laid-open No. 126632/1985 discloses a copying machine including: a charge transfer device serving as an image sensor responsive to light reflected from an copy original to be copied for generating a corresponding image signal; and a thermal head having an array of heating elements responsive to this image signal for generating heat, whereby recording is effected by causing heat-sensitive paper to generate heat.

The above-mentioned related-art example, however, requires the thermal head including an array of heating elements and an array of charge transfer elements serving as an image sensor as well as an optical lens. This may lead to the problems that the production cost is increased and that a complicated mechanism is needed. In addition, since digital recording is effected on heat-sensitive paper via the thermal head including arrayed heating elements, any attempt at improving the fidelity of recorded images cannot avoid the use of higher precision parts. This may result in the problem that the production cost is further increased.

SUMMARY OF THE INVENTION

It is an object of the present invention to provide a method of recording a clear image on a recording medium and an apparatus suitable for carrying out the same.

It is another object of the present invention to provide a method of enabling recording of an image on a recording medium by means of a compact and light-weight mechanism and an apparatus suitable for carrying out the same.

It is another object of the present invention to provide a method of easily recording an image on a three-dimensional object such as a box or a T-shirt.

It is another object of the present invention to provide an image recording method as well as an apparatus adapted to carry out such a method, the method comprising the steps of reading an image from an copy original to be copied and recording the thus-read original image on a recording medium, the former and latter steps being performed separately in time.

It is still another object of the present invention to provide an image recording method as well as an apparatus adapted to carry out such a method, the method comprising the steps of reading an image to be copied from a copy original and recording the thus-read original image on a recording medium, the former and latter steps being performed nearly simultaneously in time.

To these ends, in accordance with one aspect of the present invention, there is provided an image recording method in which a heat-sensitive sheet comprising a light-transmissive base sheet having a heat-fusible supercooled substance layer is brought into contact with a copy original such that the heat-fusible supercooled substance layer of the heat-sensitive sheet faces an original image to be copied while flashlight is projected onto the base-sheet side of the light-transmission sheet. Thus, the area of the copy original occupied by the image to be copied absorbs the light transmitted through the heat-sensitive sheet, and thus generates heat so that an adhesive area containing a pattern corresponding to the original image is formed on the supercooled substance layer. After the heat-sensitive sheet has been removed from the copy original, while the adhesiveness of the adhesive area remains effective, the adhesive area of the heat-sensitive sheet is brought into contact with a recording medium, and then removed therefrom. In consequence, the adhesive area of the heat-sensitive sheet containing the aforesaid pattern is transferred to the recording medium, thereby performing recording of the desired image.

In accordance with another aspect of the present invention, there is provided an image recording apparatus arranged to record an image on a recording medium by using a heat-sensitive sheet including a light-transmissive base sheet containing a heat-fusible supercooled substance, the image recording apparatus comprising a light source arranged to project light onto the reverse side of the heat-sensitive sheet on which no copy original is present, pressing means for pressing the reverse side of the heat-sensitive sheet against the copy original, and sheet feed means for feeding a heat-sensitive sheet which is arranged to cause the heat-sensitive sheet to travel in the opposite direction to that of travel of the apparatus body a distance substantially equivalent to that travelled by the body with respect to the copy original.

In accordance with another aspect of the present invention, there is provided a heat-sensitive sheet including a light-transmissive base sheet on which a heat-sensitive layer is formed, the heat-sensitive layer being made of a heat-fusible supercooled substance mixed with a color forming dye and a developer. Use of such a heat-sensitive sheet enables production of a colored image.

In accordance with another aspect of the present invention, there is provided a method of and an apparatus for recording an image wherein a heat-sensitive sheet including a light-transmissive base sheet having a color forming heat-sensitive layer is superimposed on the copy original such that the color forming heat-sensitive layer is maintained in contact with the the copy original, a flashlight source being intermittently flashed on the side of the aforesaid sheet opposite to its color forming heat-sensitive layer with a relative scan being produced between the copy original and the sheet, thereby causing an image portion on the copy original to be copied to absorb light from the flashlight source. Thus, the image portion generates heat to cause the color forming heat-sensitive sheet to exhibit color in accordance with a desired pattern thereby effecting recording. In consequence, an clear image can be recorded by means of an inexpensive, simple, compact, and light-weight apparatus.

In accordance with another aspect of the present invention, a wavelength selecting filter is selectively inserted between a light source and a color forming heat-sensitive sheet to selectively block light from the light source within a wavelength range of a particular wavelength or less thereby controlling the reaction of a light-reactive agent with respect to light in the aforesaid wavelength range so that optical fixation or two-color recording can be performed.

In accordance with another aspect of the present invention, there is provided a color forming heat-sensitive sheet including a base, a color forming heat-sensitive layer, and an adhesive layer having removability, wherein the latter two layers are formed on the base in that order.

Further objects, features and advantages of the present invention will become apparatus from the following description of preferred embodiments of the present invention with reference to the accompanying drawings.

DETAILED DESCRIPTION OF THE PREFERRED EMBODIMENTS

Preferred embodiments of the present invention will be described below with reference to the accompanying drawings.

Figure 1A:
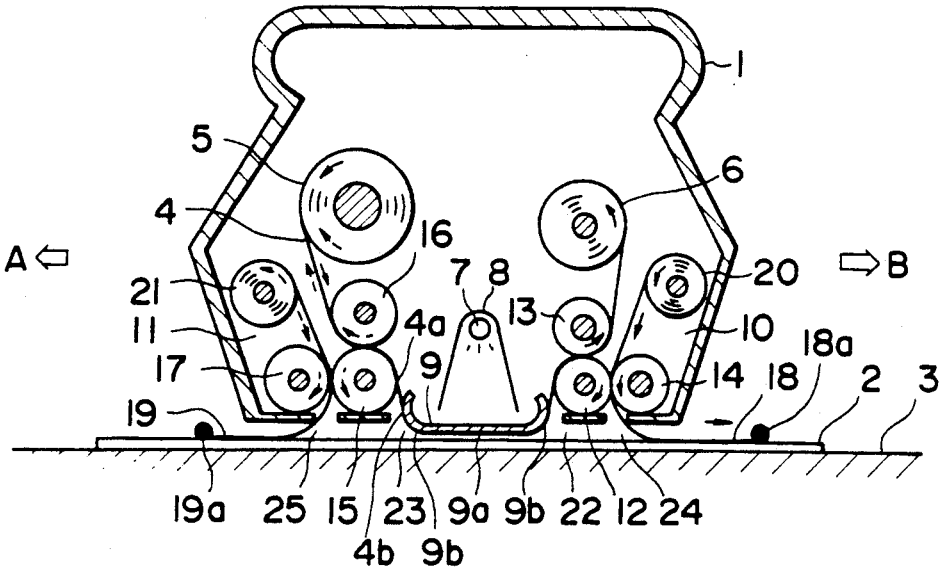
FIG. 1A is a diagrammatic, side elevational view showing, in section, a first preferred embodiment of the present invention and used in explaining a method of and an apparatus for recording an image in accordance with the invention.
Figure 1B:
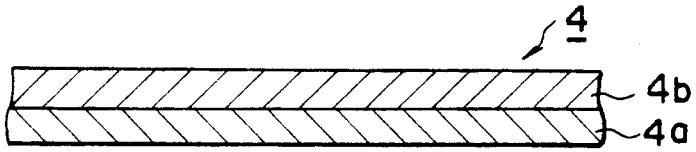
FIG. 1B is a fragmentary, cross-sectional view of a heat-sensitive sheet taken in a direction along its thickness, the sheet being used in the recording method and the apparatus both of which constitute the first embodiment.
Figure 3:
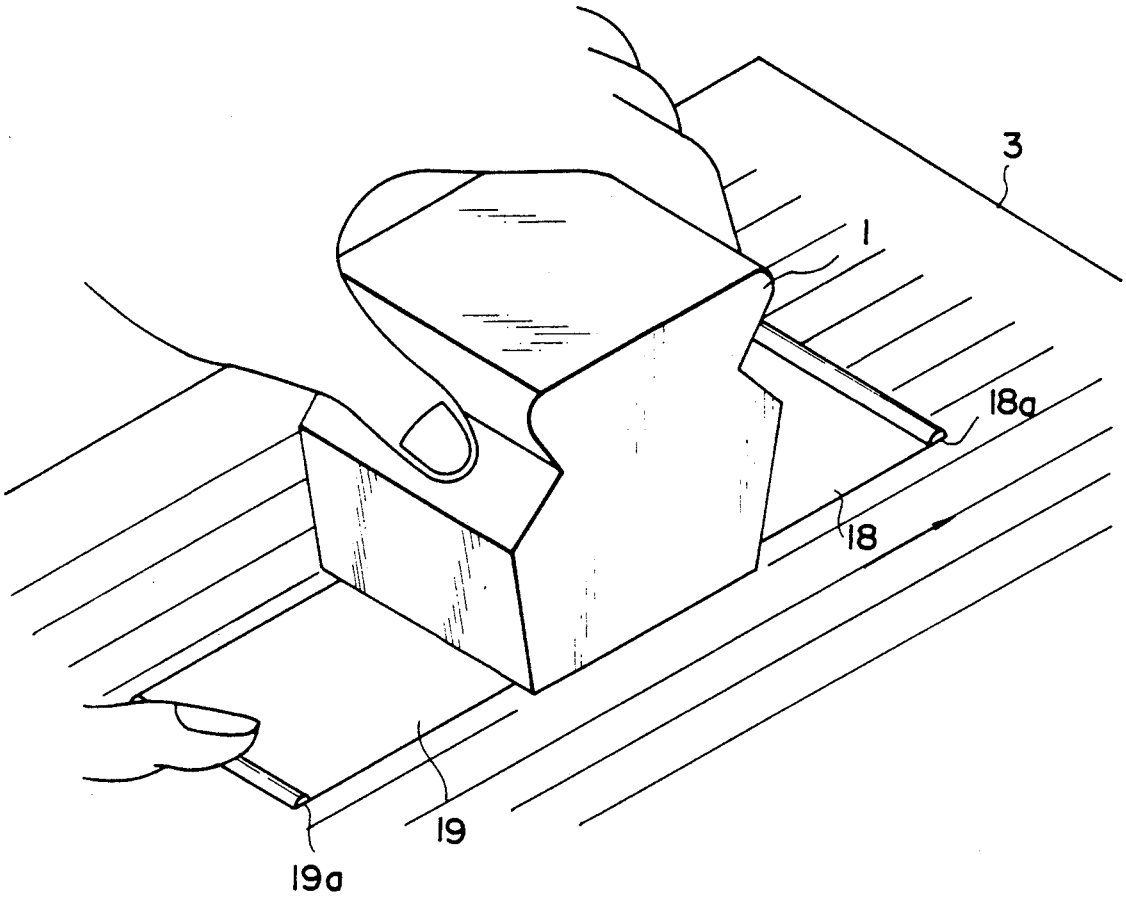
FIG. 3 is an illustration showing, in perspective, the manner in which image recording is performed using the apparatus shown in FIG. 1A.

Referring first to FIGS. 1A, 1B and 3, a first preferred embodiment will be explained.

FIG. 1A shows the first preferred embodiment of an apparatus of the invention which is arranged to effect copying with a time lag. In the first embodiment, the copying process comprises the steps of reading an original image to be copied and copying the thus-read original image onto a recording medium such as paper or a wooden box, and these steps are effected with a time lag. FIG. 1B is a fragmentary, cross-sectional view of a heat-sensitive sheet taken in a direction along its thickness, in which the heat-sensitive sheet is indicated at 4. FIG. 3 is a perspective illustration of the apparatus shown in FIG. 1A and showing the manner in which an operator is performing recording by using the apparatus.

It will be appreciated that, although, as shown in FIG. 1A, a gap is established between the heat-sensitive sheet 4 and a copy original 2, they are adapted to come into contact with each other during the recording step.

Referring to FIG. 1A, the body of the apparatus is indicated at 1, and the copy original 2 is laid on a desk 3. The heat-sensitive sheet 4 includes a light-transmissive base sheet 4*a* made of a compound such as polyethylene terephthalate or polyamide imide with a thickness of 3 to 300 μm and a heat-fusible supercooled substance layer 4*b* with a thickness of 3 to 200 μm is formed on the base sheet 4*a*. The heat-sensitive sheet 4 is wound about a roller 5, and is taken up around a take-up roller 6. The apparatus further includes a flashlight source 7, such as a xenon lamp, disposed in face-to-face relationship with the base sheet 4*a* of the heat-sensitive sheet 4 for illuminating the back surface (the base sheet 4*a*) of the heat-sensitive sheet 4 and a reflection mirror 8 for effectively reflecting the light emitted from the flashlight source 7 toward the copy original 2. A pressing means 9 allows the light from the flashlight source 7 to pass therethrough and is arranged to bring the heat-sensitive sheet 4 into intimate contact with the copy original 2. The pressing means 9 has a transmission factor with respect to light and a width substantially equal to that of the area exposed to the light from the flashlight source 7. Heat-sensitive sheet feeding means are indicated at 10 and 11, and these means 10 and 11 are respectively arranged to feed the heat-sensitive sheet 4 in the direction opposite to that of travel of the body 1, and the length of feed is substantially equivalent to a distance travelled by the body 1 with respect to the copy original 2 or a recording medium. The respective heat-sensitive sheet feeding means 10 and 11 includes: a group of rollers 12, 13, 14 and 15, 16, 17 each having the same diameter and arranged to be rotated in association with one another; and position control sheet supplying rollers 20 and 21 each consistently serving to take up a position control sheet 18 therearound under the biasing force of springs (not shown). The position control sheet 18 and 19 such as a polyester sheet or a metal sheet each have a thickness of about 50 to 300 μm and a small percentage of mechanical elongation, and in addition have a width substantially equal to that of the area exposed to the light from the flashlight source 7. Openings 22 and 23 are formed in the lower surface of the body 1 for allowing the heat-sensitive sheet 4 to pass therethrough. The heat-sensitive sheet 4 passing through the opening 23 travels under a lower surface 9*a* of the pressing means 9, then passes through the opening 22 and is then taken up around the take-up roller 6. In addition, openings 24 and 25 are formed in the lower surface of the body 1 for respectively allowing the position control sheets 18 and 19 to pass therethrough.

As described previously, the heat-sensitive sheet 4 incorporated in the apparatus shown in FIG. 1A includes a light-transmissive base sheet made of polyethylene terephthalate, polyamide imide or the like and having a thickness of about 3 to 300 μm, preferably 50 to 200 μm, and a heat-fusible supercooled substance coated thereon in the form of a layer with a thickness of 3 to 200 μm, preferably 3 to 100 μm.

The supercooled substance mentioned above indicates, for example, ink having supercooling characteristics and, in general, a heat-fusible supercooled substance of the kind that, during a predetermined period after melted or softened by heating followed by cooling, maintains its melted or softened state that allows the transfer of the substance onto a recording medium, that is, its adhesiveness even at a temperature equal to or less than its inherent melting point or softening point. The aforesaid ink having such a supercooling characteristic may, of course, be a heat-fusible, supercooled substance including a coloring agent mixed with one or more kinds of dye or pigment in a dispersed manner so as to allow transmission of the wavelength of at least one portion of visible light. The aforesaid supercooled substance may be selected from the group consisting of known plasticizers such as N-cyclohexyl-p-toluenesulfonamide, N-ethyl-p-toluenesulfonamide, dicyclohexylphthalate and the like, or the group consisting of benzotraizole, acetanilide and the like. These substances and derivatives obtained therefrom may be used in a single form or in a combined form containing two or more kinds selected thereamong. Alternatively, they may be mixed with a known type of heat-fusible binder composed of: a polyamide resin; a polyacrylic resin, or a polymeric thermoplastic resin; or various kinds of natural or synthetic wax. If they are coated as ink having supercooling characteristics and solidified on a light-transmissive base sheet, the aforesaid heat-sensitive sheet 4 can be obtained.

The following is a description of the portion of the recording process that comprises the steps of reading an image from the copy original 2 and forming the adhesive image of a pattern corresponding to the image read from the copy original 2 on the heat-fusible supercooled substance layer 4*b* of the heat-sensitive sheet 4, such a process being performed by using the recording apparatus having the above-described arrangement.

As shown in FIG. 1A, the lower surface of the body 1, i.e., the lower surface 9*a* of the pressing means 9 is laid on the image on the copy original 2. Subsequently, the position control sheet 18 is aligned while the area of the copy original 2 occupied by the image to be copied, and, after the alignment has been completed, the body 1 is laid on the copy original 2. Then, an operator grips the body 1 and moves it in the direction indicated by an arrow A with applying a force acting to press the body 1 against a desk 3. During this time, the operator holds an end 18*a* of the position control sheet 18 at the aligned position by pressing the end 18*a* against the desk 3. This allows the body 1 to move straight with respect to the copy original 2 since the position control sheet 18 has a predetermined width. While the body 1 is travelling, the position control sheet 18 is drawn off the roller 20. Since the roller 14 is slidably and rotatably in contact with the sheet 18, the roller is rotated in association with the travel of the sheet. This movement causes rotation of the roller 12 which is pressed against the roller 14 so as to clamp the position control sheet 18 therebetween, and the roller 13 is also rotated in association with the roller 14. Therefore, the length of the heat-sensitive sheet 4 corresponding to a distance travelled by the body 1 with respect to the copy original 2 is taken up around the take-up roller 6. The roller 6 are interlockingly coupled with the roller 12 or 13 via a gear train (not shown). Thus, at least while the heat-sensitive sheet 4 is passing by the lower surface 9*a* of the pressing means 9, the heat-sensitive sheet 4 is maintained in the state of being fixedly superimposed on the copy original 2; accordingly, since the relative speed therebetween is substantially zero, the heat-sensitive sheet is not shifted with respect to the copy original. Each time the heat-sensitive sheet 4 is caused to travel per unit length slightly shorter than the length of the area illuminated by the flashlight source 7, the flashlight source 7 is instantaneously turned on by known control means to illuminate the copy original 2 through the heat-sensitive sheet 4 from its base sheet 4*a*. Specifically, the flashlight source 7 is flashed in association with the displacement of the heat-sensitive sheet 4 that is slightly smaller than the illumination coverage of the flashlight source 7. This is accomplished, for example, by an arrangement in which the flashlight source 7 is caused to flash per rotation of the roller 12 by detecting the rotation thereof. The light from the flashlight source 7 passing through the heat-sensitive sheet 4 is absorbed by the image of the copy original 2 to be copied (for example, black letters), thereby causing the image to generate heat. The thus-generated heat acts to fuse the area of the supercooled substance layer 4*b* of the heat-sensitive sheet 4 that corresponds to the just-mentioned image to be copied, and thus a pattern corresponding to the image of the copy original 2 is formed as an adhesive image (latent image) on the supercooled substance layer 4*b* in the area defined between opposite curved end portions 9*a* and 9*b* of the pressing means 9. While the body 1 is travelling, a series of adhesive images are formed in this manner and sequentially removed from the copy original 2, then travelling along the curved end portion 9*b* of the pressing means 9, and then wound around the take-up roller 6. In order to enable the heat-sensitive sheet 4 to be stably wound around the roller 6, it is preferable to form releasing layers, respectively, on the surface of the roller 12 and the back surface of the light-transmissive base sheet 4*a* of the heat-sensitive sheet 4 that faces the flashlight source 7. The distance travelled by the body 1 for the purpose of image formation is preferably a length equal to or less than the length of the position control sheet 18. After completion of image formation, if the end 18*a* is released, the sheet 18 is taken up around the roller 20 by the force of the aforesaid spring (not shown).

The following is a description of the succeeding step of copying on a desired recording medium the adhesive image formed on the heat-sensitive sheet 4 in the above-described steps. The description is performed with specific reference to FIG. 1.

While the adhesive image formed on the heat-sensitive sheet 4 in the above-described steps maintains its adhesiveness, a desired recording medium such (not shown) as a wooden box, a notebook or a T-shirt, instead of the copy original 2, is placed on the desk 3, and the body 1 is then laid on the recording medium (not shown) such that the lower surface of the body 1, i.e., the lower surface 9*a* of the pressing means 9 opposes the recording medium. Then, the position control sheet 19 is held in position on the recording medium, thus locating the body 1 at an appropriate position on the recording medium. In the previously-described step, the end portion 18*a* of the position control sheet 18 has been held, but, in this step, as shown in FIG. 3, an opposite end portion 19*a* of the position control sheet 19 is held so as to allow the body 1 to travel in the direction indicated by an arrow B. In order that the adhesive image of the pattern formed on the heat-sensitive sheet 4 in the previously-described steps is sufficiently pressed against the recording medium, the operator moves the body 1 in the direction of the arrow B while strongly pressing the body 1 downwardly against the recording medium. Although such a recording medium is not specifically illustrated, it may be considered that it has a sheet-like form, for example, similar to that of the copy original 2. In the same manner as that of the previously-described steps, the position control sheet 19 is sequentially drawn off the roller 5, and the roller 17 is thus rotated in association with the movement of the sheet 19. The rotation of the roller 17 causes associated rotations of the rollers 15 and 16. Thus, the heat-sensitive sheet 4 having a surface with the adhesive image (latent image) of the pattern to be copied is at least passed by the pressing means 9 with the sheet 4 superimposed on the recording medium, and then is sequentially wound around the roller 5. In this case, since the relative speed becomes substantially zero between the sheet 4 and the recording medium, they are not shifted from each other during movement.

While moving along the curved end portion 9*b* of the pressing means 9 and advancing into the opening 23, the heat-sensitive sheet 4 is separated from the recording medium. At this time, since the adhesive portion of the supercooled substance layer 4*b* that constitute the adhesive image of the pattern formed in the previously-described steps maintains its adhesiveness, the adhesive image of the pattern is transferred onto the recording medium so that an image corresponding to the original image of the copy original 2 is formed on the recording medium.

It is to be noted that the lighting circuit (not shown) of the flashlight source 7 is turned off via a switch (not shown).

A second preferred embodiment of the present invention will be described below with specific reference to FIG. 2. The illustrated second embodiment is arranged to simultaneously perform the steps of reading an image from the copy original and copying the thus-read image on a sheet-like recording medium.

Figure 2:
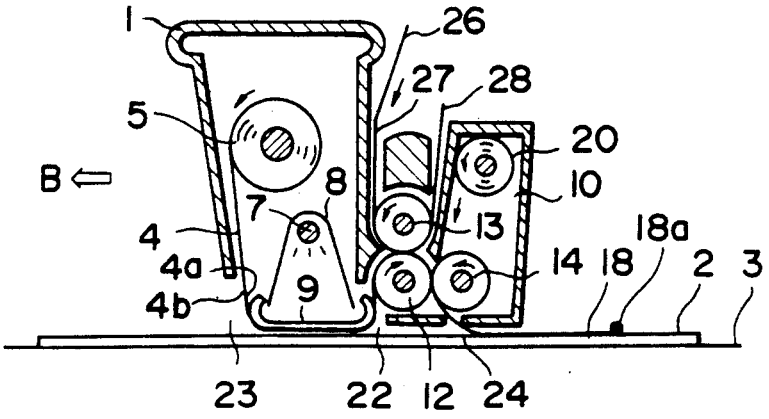
FIG. 2 is a diagrammatic, side sectional view showing a second preferred embodiment of the present invention and used in explaining a method of and an apparatus for recording an image in accordance with the invention.

It will be appreciated that, although, as shown in FIG. 2, a gap is established between the heat-sensitive sheet 4 and the copy original 2, they are adapted to come into contact with each other during the recording step.

In FIG. 2, like reference numerals are used to denote the like or corresponding elements relative to those in the above-described first embodiment. One feature of the second embodiment indicated at 26 is that a recording medium is a sheet-like recording medium such as a sheet of recording paper or an OHP sheet and another feature is that the body 1 has an opening 27 through which the sheet-like recording medium 26 is inserted and an opening 28 through which the sheet-like recording medium 26 having a copied image and the used heat-sensitive sheet 4 are discharged together.

The second embodiment operates as follows. After an operator has inserted the sheet-like recording medium 26 through the opening 27 into the body 1 by hand, the position control sheet 18 is aligned with the area of the copy original 2 occupied by an image to be copied, and, after the alignment has been completed, the body 1 is laid on the copy original 2. Then, the operator grips the body 1 and moves it on the copy original 2 in the direction indicated by an arrow B while holding the end 18*a* of the sheet 18 against the copy original 2. As previously described with reference to FIG. 1A, as the position control sheet 18 is drawn off the roller 5, the roller 14 is rotated because of its frictional contact with the sheet 18, and in turn the rotation of the roller 14 causes the associated rotations of the rollers 12 and 13 which are pressed against each other. The flashlight source 7 illuminates the pressing means 9 at the same timing as that of the aforesaid first embodiment, and a pattern corresponding to the image portion of the copy original 2 illuminated by the source 7 through the pressing means 9 is thus formed as an adhesive image (latent image) on the surface area of the heat-sensitive sheet 4. The heat-sensitive sheet 4 having such an adhesive image and the sheet-like recording medium 26 inserted through the opening 27 are tightly pressed against each other in the nip between the rollers 12 and 13. Subsequently, the heat-sensitive sheet 4 is separated from the recording medium 26, but, at this time, the adhesive portion of the supercooled substance layer 4*a* carrying the adhesive image of the copied pattern is transferred onto the recording medium 26. In consequence, the image corresponding to the original image of the copy original 2 is copied on the recording medium 26.

In this manner, the second preferred embodiment is arranged to perform the two independent steps of reading an image from the copy original and transferring the image onto the recording medium in a single, continuous step, i.e., at substantially the same time.

It is to be noted that the image copied on the recording medium obtained by either of the embodiments of FIGS. 1A and 2 may be naturally fixed, or may be further firmly fixed by using heating means or vapored solvent applying means. Also, either of these means may be used to change the color of the adhesive image transferred to the recording medium or the color of the portion of a sheet occupied by the adhesive image. For this purpose, a material composed of a known heat-sensitive color former mixed with a supercooled substance may also be used as supercooled ink.

A sublimated dye may be vaporized by heating to be deposited on the adhesive image portion transferred to the recording medium, thereby changing the color of the adhesive image portion. In this case, a recording medium made of paper or cellulosic material is not dyed because of its week affinity with respect to dye.

In order to easily dye the adhesive image using the aforesaid sublimated dye, a material composed of the previously-mentioned heat-fusible supercooled substance mixed with hydrophobic polymer such as polyester, acryl or acetate having affinity or chemical absorption with respect to a sublimable dye having a structure containing a polar group such as —OH, —$NH_2$, —$NO_2$or —$SO_2$ may be employed to form the supercooled substance layer. In addition, a material which changes its color by chemical reaction with the sublimated dye may be mixed with the supercooled substance layer. Typical examples of the aforesaid sublimated dye are listed below:

Color Index Disperse Yellow 7 (for example, "halaneil Yellow 5RX" manufacture by BSAF);

Color Index Disperse Red 60 (for example, "Imikalon" manufactured by Sumitomo Chemical Co., Ltd.); and Color Index Disperse Blue 80.

Of course, means for realizing the above-described dyeing or coloring may be disposed in the apparatus shown in FIGS. 1 and 2.

For example, in the second embodiment shown in FIG. 2, such means may be disposed at an intermediate portion between a location where, after the adhesive image of a pattern to be copied is transferred onto the recording medium 26 by passing it through the nip between the rollers 12 and 13 and the opening 28 which allows the recording medium 26 having a surface with thus-transferred adhesive image to be discharged therethrough.

In addition, a filter may be inserted between the flashlight source 7 and the opposed surface of the pressing means 9 for cutting off light in a wavelength range which may be absorbed by the heat-sensitive sheet.

According to either the thickness of the supercooled substance layer deposited on the heat-sensitive sheet or the kind of the original image recorded thereon, the heat-sensitive sheet mentioned in the aforesaid respective embodiments may be replaced with a new one as required after it has been used once or several times.

As described above in conjunction with the first and second preferred embodiments of this invention, in accordance with one aspect of the invention, it is possible to provide a method of and an apparatus for recording an image in both of which a copy original written with a pencil or an original image such as a page of newspaper or a book can be freely and easily recorded on a sheet-like recording medium such as a notebook and a cardboard as well as a three-dimensional object such as a wooden box, a T-shirt or a suit.

In addition, in the above-described first and second embodiments, use of the flashlight source such as a xenon lamp which can instantaneously emit light produces a remarkable difference in temperature rise between the portion of a copy original containing an image and the other portion of the same containing no image, and this enables formation of a clear adhesive image on the heat-sensitive sheet, thereby achieving a clearly recorded image.

A third preferred embodiment of the present invention will be described below with reference to FIG. 4. The third embodiment is capable of providing an image which is copied in color.

Figure 4:
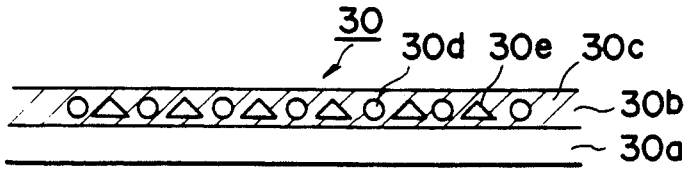
FIG. 4 is a diagrammatic, sectional view of a heat-sensitive sheet suitable for use with a third preferred embodiment of the present invention.

The third embodiment uses a heat-sensitive sheet 30 as diagrammatically shown in FIG. 4 instead of the aforesaid heat-sensitive sheet 4. The heat-sensitive sheet 30 includes a light-transmissive base sheet 30*a* on which a heat-sensitive layer 30*b* is formed, and the heat-sensitive layer 30*b* is made of a heat-fusible supercooled substance 30*c* mixed with a color-forming dye 30*d* and a developer 30*e*. It is thus possible to record an colored image by a combination of the heat-sensitive sheet 30 and the same method and apparatus as described previously. Since the previous description performed in conjunction with FIGS. 1A, 2 and 3 are applicable to the description of the third embodiment of an image recording method and an apparatus using the same, detailed description thereof is omitted for the sake of simplicity.

By way of example, a method of obtaining a green recorded image will be described below.

A heat-sensitive color former to be mixed with the heat-fusible supercooled substance 30*c* is selected from the group consisting of known substances which form color in a single form or the group of consisting of color-forming two-component mixtures Specifically, the former group consists of indole derivatives, pyrroline derivatives, dithiocarbamic acid metal salt and other substances from which a coloring substance is derived by thermal decomposition caused by heating The latter group consists of various heat-sensitive color formers each containing two kinds of substance which assume a solid form at room temperature but is melted into a liquid form by heating to react with each other thereby forming color; for example, two-component metal color forming compounds obtained from the following combinations of: known long-chain fatty acid iron salt and phenol substances; organic acid heavy metal salt and an alkaline earth metal; and heavy metal nitrate and a sulfuric compound or two-component color forming dyes obtained from any of the following combinations of various kinds of leuco dye and a color developer such as clay acid, nitric acid or maleic acid. The aforesaid color formers are colorless or nearly colorless at room temperature, but exhibit deep color by heating. Accordingly, such color formers satisfy the aforesaid requirements and are suitable for use in the step of obtaining an colored image which will be described later.

In particular, the supercooled substance 30*c* used in the third embodiment is made of a polyamide resin including dimer acid as a base resin (softening point: 82° C., molecular weight: 2000–3000, acid value: 2–3; amine value: 1–2; LMD - 20; manufactured by Sanwa Chemical Co., Ltd.) which is heat-melted in toluene in an amount equivalent to 5 to 20 percent by weight, preferably, 8 to 15 percent by weight. Such a supercooled substance 30*c* is transparent, and is solid at room temperature but, after melted by heating, exhibits the supercooling characteristic during a period of time from several minutes to hours, and in addition, causes no fusion of the color former used in the third embodiment. Therefore, if such a color former is mixed with any of the aforesaid supercooled substances at room temperature, no color is produced; accordingly, such supercooled substance is suitable for use in the third embodiment.

The heat-sensitive color former used in the third embodiment is one selected from the group consisting of two-component color forming dyes. Specifically, the color forming dye 30*d* is one kind of leuco dye referred to as "3, 3 (3', 6'- tetramethyldiaminofluorenyl) - 6 -dimethylaminophthalide (manufactured by Yamamoto Chemical Synthesization Co., Ltd.) and the developer 30*e* is bisphenol A. More specifically, the aforesaid color forming dye 30*d* is mixed with the developer 30*e* at a weight ratio of 1 : 1 to 1 : 5, preferably, 1 : 2 to 1 : 3, and the thus-obtained mixture is mixed with the aforesaid supercooled substance by dispersion in an amount equivalent to 2,3 to 50 percent by weight, preferably, 5 to 15 percent by weight. Also, 2 to 3 wt.% stearic acid amide is dispersed as a sensitizer in such a supercooled substance. This heat-sensitive color former exhibits no substantial color at room temperature but shows deep green at a temperature of about 100° to 160° C.

The thus-prepared liquid containing the aforesaid substance dispersed therein is coated over polyethylene terephthalate film having a thickness of 50 μm, and the dried one is used as a heat-sensitive sheet.

Use of such a heat-sensitive sheet enables production of a clearly copied image represented in deep green through the image forming steps previously described in the first and second embodiments.

Also, in order to protect a copy original, transparent particles having a particle diameter of 1 μm or less, preferably 0.5 μm or less, for example, hydrophobic colloidal silica may be deposited on the surface of the heat-sensitive layer of the heat-sensitive sheet.

It is to be noted that, the term "heat-sensitive color former" used herein is defined as a substance of the type that exhibits color owing to its irreversible chemical reaction in a temperature range equal to or greater than a predetermined temperature.

Figure 7:
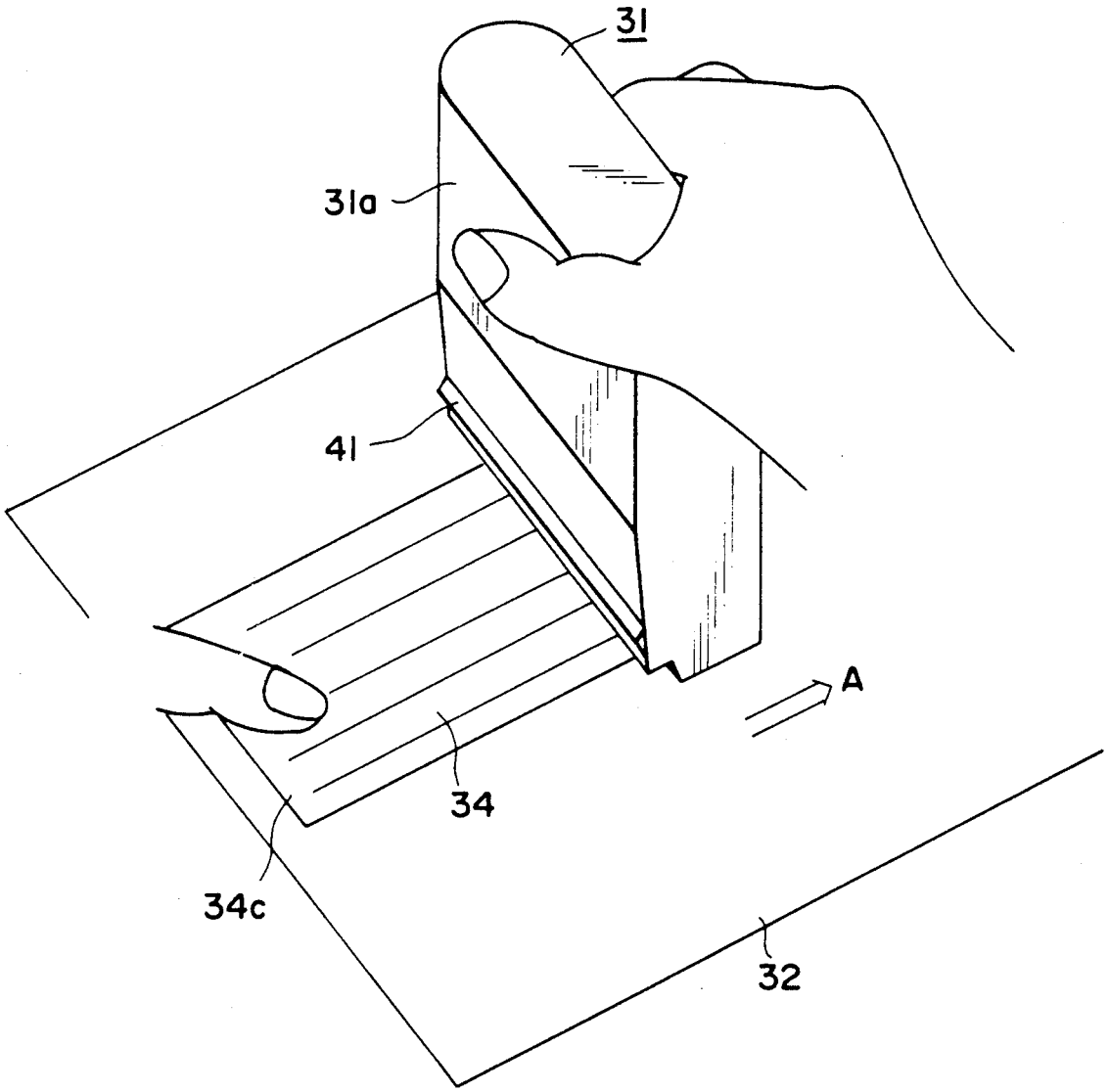
FIG. 7 is an illustration showing, in perspective, the manner in which image recording is performed using the image recording apparatus shown in FIGS. 5A and 6A.

A fourth preferred embodiment of the present invention will be described below with reference to FIGS. 5A, 5B and 7.

Figure 5A:
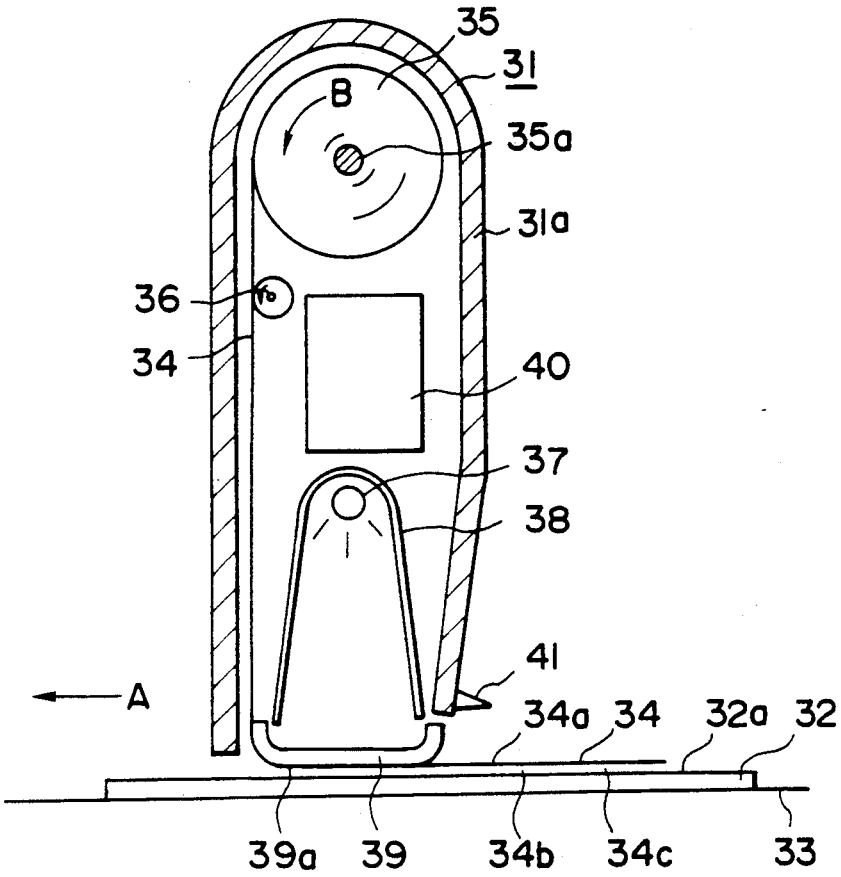
FIG. 5A is a diagrammatic, side elevational view showing, in cross section, a fourth preferred embodiment of a method of and an apparatus for recording an image in accordance with the present invention.
Figure 5B:
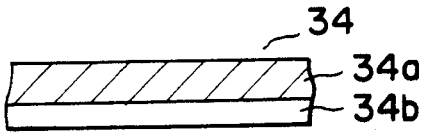
FIG. 5B is a fragmentary, cross-sectional view of a color forming heat-sensitive sheet taken in a direction along its thickness, the sheet being used in the fourth preferred embodiment.

FIG. 5A is a diagrammatic side elevational view showing, in cross section, the fourth embodiment of an image recording apparatus in accordance with the present invention. FIG. 5B is a fragmentary, cross-sectional view of a color forming heat-sensitive sheet taken in a direction along its thickness in which the heat-sensitive sheet is indicated at 34.

As illustrated, the fourth embodiment of an image recording apparatus has a body indicated at 31. A copy original 32 is laid, for example, on a desk 33. The color forming heat-sensitive sheet 34 includes a light-transmissive base sheet 34*a* having a color forming heat-sensitive layer 34*b*. The color forming heat-sensitive sheet 34 is wound around a shaft 35*a* to form a sheet roll 35. A guide roller 36 is disposed so as to guide the color forming heat-sensitive sheet 34 toward an original-image reading section. A flashlight source 37 such as a xenon lamp is disposed so as to project light the color forming heat-sensitive sheet 34 from its back side (from the side of the sheet 34 occupied by the base sheet 34*a*), and is arranged to emit light having a wavelength equal to or greater than, for example, 300 nm. A reflection mirror 38 is disposed so as to effectively and uniformly reflect light from the flashlight source 37 toward a copy original 32. A pressing means 37 is secured to a cover 31*a* for the body 31 so as to allow the light from the flashlight source 37 to pass therethrough and to bring the heat-sensitive sheet 34 into intimate contact with an surface 32*a* of the copy original 32 by applying pressure to the back surface of the sheet 34. The pressing means 39 has transmission factor with respect to light and a width substantially equal to the illumination coverage of the flashlight source 37, and is secured at their opposite ends to the cover 31*a* for the body 31. An electric power supply and drive circuit for the flashlight source 37 is indicated at 40 (refer to FIG. 8 for details). A cutter 41 is disposed so as to cut the color forming heat-sensitive sheet 34.

As fragmentarily shown in 5B, the color forming heat-sensitive sheet 34 used in the fourth embodiment includes the light-transmissive base sheet 34*a* constituted by transparent film made of polyethylene terephthalate, polyamide imide or the like with a thickness of about 3 to 300 μm, preferably, about 25 to 50 μm or tracing paper or other translucent paper, such as so-called transparency, impregnated with paraffin or oil; and a layer coated over the light-transmissive base sheet 34*a*, the layer having a thickness of about 10 to 100 μm, preferably, 20 to 70 μm and composed of a binder and a heat-sensitive color former dispersed therein which will be described later.

The term "heat-sensitive color former" used herein is defined as a substance which normally exhibits no color or light color but shows deep color by heating. Specifically, the heat-sensitive color former used in the fourth embodiment exhibits color at an elevated temperature to which the original image portion is heated by exposure to light emission of a flashlamp, that is, at temperatures of about 80° to 160° C. or about 10° C. lower than these temperatures (since the original image portion is colored, when exposed to light, the original image portion absorbs the light and its temperature is elevated due to its heat accumulation.

The heat-sensitive color former 34*b* employed in the fourth preferred embodiment includes a leuce dye referred to as "3, 3 (3', 6'- tetramethyldiaminofluorenyl) - 6 - dimethylaminophthalide which is one of two-component color forming dyes (manufactured by Yamamoto Chemical Synthesization Co., Ltd.) and a developer referred to as "4, 4'-isopropylidenediphenyl (bisphenol A). More specifically, the former color forming dye is mixed with the latter developer at a weight ratio of 1 : 3, and the thus-obtained mixture is dispersed in a binder composed of polyacrylic amide in an amount equivalent to about 10 percent by weight, and about 2 wt.% stearic acid amide as a sensitizer is dispersed in the binder. The thus-prepared mixture is coated as the heat-sensitive color former 34*b* over 25-μm-thick PET film (the light-transmissive base sheet 34*b*) such as to form a layer having a thickness of about 50 μm thereover, and this coated sheet is used as the color forming heat-sensitive sheet 34. This color forming heat-sensitive sheet 34 is colorless (translucent) at room temperature, but exhibit deep green at a temperature of about 100° to 120° C. Accordingly, use of such a color forming heat-sensitive sheet 34 enables production of a clearly copied image represented in deep green through the image forming steps previously described.

It is to be noted that, in the above-described recording method constituting the fourth embodiment, since the color forming heat-sensitive sheet 34 is brought into intimate contact with the copy original and in this state the copy original is illuminated by a flashlamp through the sheet 34, the sheet 34 coated with the heat-sensitive color former 34*b* as described above is preferably translucent or transparent as a whole. In addition to the aforesaid substances, a heat-sensitive color former satisfying such a requirement may preferably be selected from: the group consisting of substances which exhibit color in single form by thermal decomposition, such as indole derivatives, pyrroline derivatives, dithiocarbamic acid metal salt and nitrose compounds; the group consisting of substances which exhibit color in two-component form, that is, which include a binder resin as well as electron donor and electron acceptor dispersed therein as solid particles, which electron donor and acceptor assume a solid state at room temperature but are melted into a liquid state by heating, thus reacting with each other to produce color. The latter group consists of two-component color formers of the metal compound type such as: a mixture of long-chain fatty acid iron salt (secondary iron stearic, secondary iron myristate) and phenol substances (tannic acid, gallic acid and ammonium salicylate); a mixture of organic heavy metal salt (acetic acid, stearic acid, palmitic acid and other salts resulting from Ni, Co, Pb, Cu, Fe, Hg and Ag) and alkaline earth metal sulfide (CaS, SrS or BaS); and a mixture of salt resulting from heavy metal nitrate (Ag, Pb, Hg or Th) and a sulfur compound (Na-tetrathionate, sodium thiosulfate or thiourea). Such a heat-sensitive color former is used in the state of being dispersed in a binder composed of a thermoplastic resin such as polyvinyl butyral. In addition, the heat-sensitive color former satisfying such a requirement may preferably be selected from the group consisting of two-component color formers of the color forming dye type constituted by various combinations of: leuco dyes such as 3, 3-bis (p-dimethylaminophenyl) phthalide, 3-dimethylamino-6 methoxyfluorane, 3-phenyl-8'-methoxybenzoindolinospiropyran; and phenol compounds (developer) such as 4, 4'-isopropylidenediphenyl (bisphenol A), catecohol and resorcin, and these two-component color formers are used in the state of being dispersed in a binder such as polyacrylic amide, methylcellulose or the like.

The following is a description of the step of forming a colored image corresponding to a desired image of the copy original 32 on the surface of the aforesaid color forming heat-sensitive sheet 34 having the aforesaid arrangement.

Referring to FIG. 5A, the color forming heat-sensitive sheet 34 is wound around the shaft 35*a* in the form of the sheet roll 35. The heat-sensitive sheet 34 is passed along a lower surface 39*a* of the pressing means 39 with the color forming heat-sensitive layer 34*b* of the former maintained in contact with the copy original 32, and then a leading end 34*c* of the sheet 34 is drawn out of the body 31. Then, the body 31 is laid on the copy original 32 such that the lower surface 39*a* of the pressing means 39 is positioned directly above the original image of the copy original 32 to be copied.

Subsequently, an operator presses the lead end 34*c* of the heat-sensitive sheet 34 against the copy original 32 by either hand while holding the body 31 by the other hand. In this state, while applying force acting to press the body 31 against the desk 33 so that the heat-sensitive sheet 34 is maintained in intimate contact with the copy original 32, the operator causes the body 31 to scan in the direction indicated by an arrow A of FIG. 5A. (FIG. 7 shows in perspective the manner in which the operator operates the body 31.) During this scan, each time the length of the heat-sensitive sheet 34 slightly smaller than the illumination coverage of the flashlight source 37 is fed, the aforesaid control means 40 causes the flashlight source 37 to instantaneously emit light so as to illuminate the copy original 32 from the surface of the heat-sensitive sheet 34 opposite to the side comprised of color forming heat-sensitive layer. More specifically, the flashlight source 37 is caused to flash in association with the unit displacement of the heat-sensitive sheet 34 through a distance slightly smaller than the illumination coverage of the flashlight source 37. This synchronized flash is, for example, accomplished in the following manner. As illustrated, a guide roller 36 is disposed for free rotation in cooperation with the feeding of the sheet 34, and detecting means (not shown) is disposed so as to detect the rotation of the guide roller 36. The detecting means (not shown) detects the displacement of the sheet 34 through detection of the rotation of the guide roller 36, and inputs the thus-obtained detection signal to the control means 40. The flashlight source 37 is arranged to flash in response to the signal input.

In this case, however, if the body 1 is caused to scan excessively fast, the time required to electrically charge the flashlight source or flashlamp 37 becomes short, and thus it may become difficult to obtain a sufficient period of charging time. To obviate this problem, the central shaft 35*a* supporting the sheet roll 35 may be provided with a clutch (not shown) for limiting the rotation thereof. With this arrangement, if the scanning speed of the body 31 is too fast with respect to the charging time of the flashlight source 37, the feed rate of the heat-sensitive sheet 34 can be limited by the aforesaid clutch.

Figure 8:
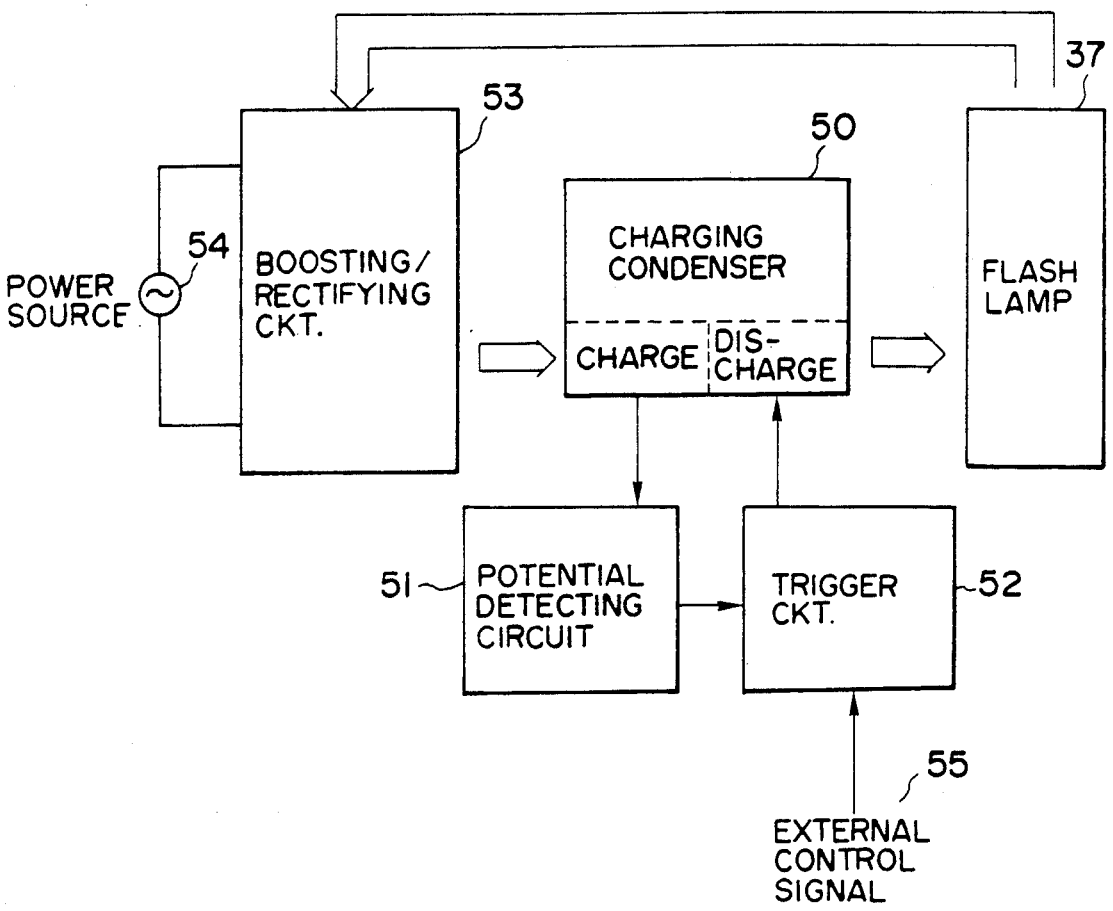
FIG. 8 is a block diagram of the entire construction of the image recording apparatus constituting the fourth and fifth embodiments of the present invention.

As shown in FIG. 8, in this case, an on-off signal from the clutch is transmitted to a trigger circuit 52 as an external control signal 55 (for example, a detection signal from the detection means), and known means may be used to interlock the lighting of the flashlamp 37 with the feed control of the sheet 34. As an example, as shown in FIG. 8, a charging capacitor 50 may be incorporated so as to light the flashlamp 37. A potential detecting circuit 51 is arranged to detect the completion of charging of the charging capacitor 50, and the thus-obtained detection signal representing the completion of charging is supplied to the trigger circuit 52.

On the other hand, upon commencement of a recording operation, the operator first draws a unit length of the heat-sensitive sheet 34 out of the body 31. This drawing operation is completed when the aforesaid clutch stops the rotation of the sheet roll 35. Simultaneously, the detecting means, for example, transmits a signal indicative of the completion of sheet feeding to the trigger circuit 52. Subsequently, when the signals representing the completion of charging and that of sheet feeding are both transmitted to the trigger circuit 52, the trigger circuit 52 generates a trigger signal to cause the charging capacitor 50 to discharge, thereby lighting the flashlamp 37. Subsequently, limiting control with respect to sheet feeding is released (the clutch is disengaged), and the body 31 is then cause to scan the succeeding unit length of the heat-sensitive sheet 34 and the charging capacitor 50 for the flashlamp 37 is electrically charged. Thus, the operation of flashing the flashlamp 37 is similarly repeated in accordance with the unit length of the sheet 34 to be fed. Incidentally, a boosting/rectifying circuit is indicated at 53, and serves to rectify the voltage from the power source 54 such as a battery and supply the rectified voltage to the charging capacitor 50.

Referring back to FIG. 5A, the light emitted from the light source 37 and transmitted through the color forming heat-sensitive sheet 34 is absorbed by an image portion of the copy original 32 (for example, black letters), and thus heat is produced in the image portion. The thus-produced heat acts upon the area of the color forming heat-sensitive layer **34*b* of the heat-sensitive sheet 34 that corresponds to the aforesaid image portion to cause such an area to exhibit color, thereby enabling sequential recording of colored images on the heat-sensitive sheet 34**.

When the desired colored image is recorded on the heat-sensitive sheet 34 through the above-described process, the portion including the recorded image is cut off the sheet 34, and this completes the image recording process.

As described above, the fourth preferred embodiment enables clear and high-quality analog recording by means of a remarkably simple, compact and light-weight apparatus.

Figure 6A:
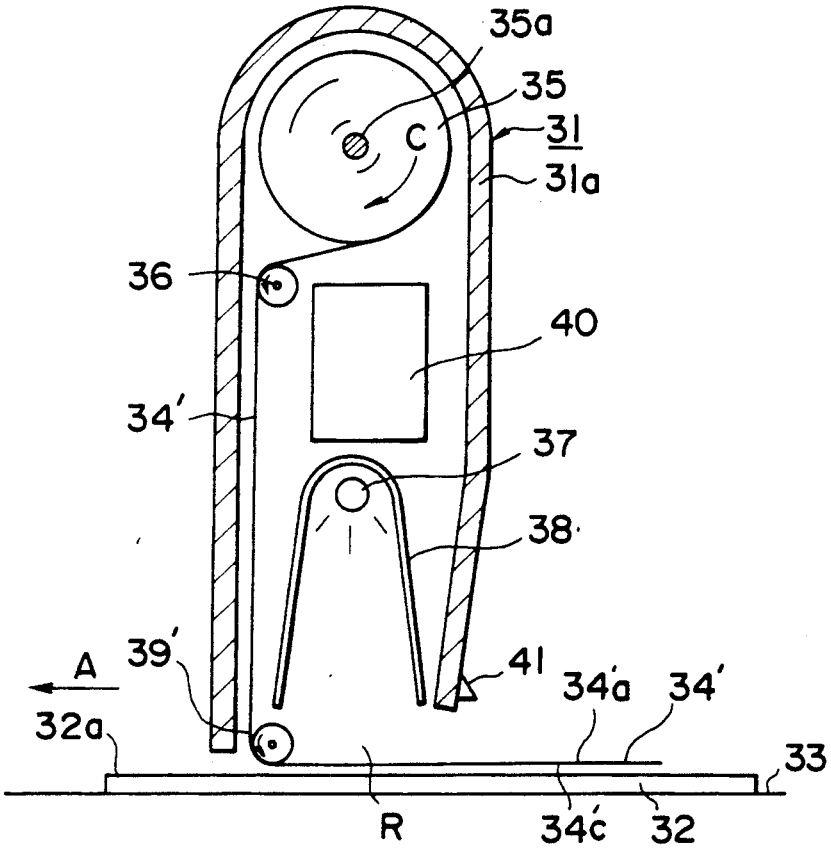
FIG. 6A is a diagrammatic, side elevational view showing, in cross section, a fifth preferred embodiment of a method of and an apparatus for recording an image in accordance with the present invention.

FIG. 6A is a diagrammatic side elevational view showing, in cross section, a fifth preferred embodiment of an image recording apparatus in accordance with the present invention. FIG. 5B is a fragmentary, cross-sectional view of a color forming heat-sensitive sheet taken in a direction along its thickness in which the heat-sensitive sheet is indicated at **34*a***.

In FIG. 6A, like reference numerals are used to denote the like or corresponding elements relative to those shown in FIG. 5A, and description thereof is omitted.

Referring to FIG. 6A, a color forming heat-sensitive sheet with an adhesive layer is indicated at 34', and a pressing means serving as a feed roller is indicated at 39'.

The color forming heat-sensitive layer 34' with an adhesive layer comprises the color forming heat-sensitive sheet 34 described previously in the fourth embodiment and in addition an adhesive layer **34'*c* with removability formed on the color forming layer 34*b* of the sheet 34**. The term "adhesive layer with removability" used herein is defined as an adhesive layer which can be removed after adhesion without losing its adhesiveness. For example, a spray type paste (3M Company, -55) composed of 10% acrylic rubber, 65% 1 . 1 . 1 trichloroethane and 25% LPG may be applied by spraying over a color forming layer 34'*b* of the color forming heat-sensitive sheet 34'. (In this case, in order to prevent color change and decolorization from occurring in a colored image portion under the influence of the components contained in the adhesive layer, a polymeric protective layer may be formed between the color forming layer and the adhesive layer.)

Figure 6B:
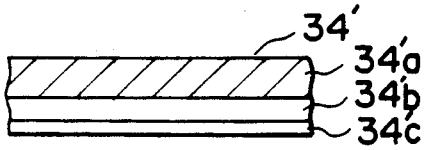
FIG. 6B is a fragmentary, cross-sectional view of a color forming heat-sensitive sheet taken in a direction along its thickness, the sheet being provided with an adhesive layer used in the fifth embodiment.

In this case, the color forming heat-sensitive sheet 34'with the adhesive layer 34'*c* is disposed such that the adhesive layer 34'*c* faces radially inwardly of the sheet roll 35 (toward the central shaft **35*a*) and also faces the copy original 32 during an image recording operation. Therefore, the sheet roll 35 is fitted onto the shaft 35*a* such that the heat-sensitive sheet 34' is wound around the shaft 35*a* in the direction opposite to that of winding of the sheet used in the fourth embodiment (the direction of the arrow B), i.e., in the direction indicated by an arrow C shown in FIG. 6. The heat-sensitive sheet 34' is passed by the guide roller 36 and the pressing roller 39' serving as sheet feed means, then through an original reading section R and then out of the body 31. Subsequently, the pressing roller 39' of the body 31 is held, as by hand, against a desired copy start portion of the copy original 32 to be copied, and thus the adhesive layer 34'*c* of the heat-sensitive sheet 34' is pressed against the copy original 32. Then, while applying force acting to press the body 31 against the desk 33, the operator causes the body 31 to scan until the heat-sensitive sheet 34' completely covers the illumination coverage of the flash lamp 37**.

As described above, the flashlight source 37 is caused to instantaneously emit light so as to perform recording of an image corresponding to the original image to be copied. Then, as in the case of the fourth embodiment, while the body 31 is being caused to scan in the direction of the arrow A, the flashlight source 37 is caused to intermittently flash, thereby performing image recording as in the case of the fourth embodiment.

Through the aforesaid process, the portion on which the desired image is recorded is cut off the heat-sensitive sheet 34' by means of the cutter 41. Then, if the cut portion is removed from the copy original 32, it can be stuck to a desired place such as a page of a notebook or a memo pad, and can also be stored. The aforesaid fourth embodiment requires the pressing means 39 which are located over the illumination coverage of flashlight. In the fifth embodiment, however, since the heat-sensitive sheet 34' has a surface made of the adhesive layer **34'*c*, such a pressing means 39 is not necessarily be needed. This is because, once the heat-sensitive sheet 34' has been pressed via the pressing roller 39', it is possible to maintain the intimate contact between the copy original 32 and the heat-sensitive sheet 34' because of the presence of the adhesive layer 34'*c*. This prevents power loss from being caused by the pressing means 39 absorbing flashlight, and in addition, enables production of apparatus having a further simple structure. Also, the intimate contact between the heat-sensitive sheet 34' and the copy original 32 can be maintained positively and uniformly to improve the thermal conductivity between the copy original 32 and the sheet 34' thereby efficiently and uniformly achieving clear image recording. In the previously described fourth embodiment, it is necessary to press the leading end of the heat-sensitive sheet 34 against the copy original 32 by hand, thus requiring an operation using both hands. However, in the case of the just-described fifth embodiment, the leading end of the heat-sensitive sheet 34' first sticks to the copy original 32; accordingly, it is possible to operate the body 31 by one hand. This succeeds in further simplifying the operation of the body 31. In addition, the adhesive force acting between the sheet 34 and the copy original 32 positively assures the straight movement of the body 1** during a scanning operation.

The following is a description of another modified form of heat-sensitive sheet usable in the fourth and fifth embodiments.

Figure 5C:
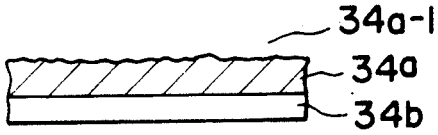
FIG. 5C is a view similar to FIG. 5B, but showing another modified form of color forming heat-sensitive sheet having one surface which is subjected to a conventional blasting treatment so as to enable direct writing thereon with a known writing instrument.
Figure 6C:
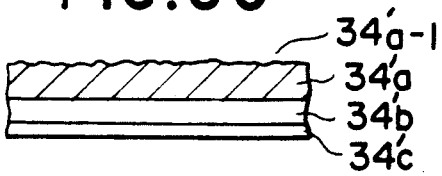
FIG. 6C is a view similar to FIG. 6B, but showing another modified form of color forming heat-sensitive sheet provided with an adhesive layer, the surface of which is subjected to a conventional blasting treatment so as to enable direct writing thereon with a known writing instrument.

Referring to FIGS. 5C and 6C, the respective light-transmissive base sheets 34*a* and 34*a'* of the heat-sensitive sheets 34 and 34' have back surfaces 34*a*-1 and 34'*a*-1 which are worked through a blasting treatment so as to provide the maximum surface roughness of about 3 to 10 μm. Such a blasting treatment enables direct writing on the respective surfaces 34*a*-1 and 34'*a*-1 of the recorded sheet 34 and 34' by means of a writing instrument such as a pencil. It is to be noted that, even after recording has been performed by the methods depicted in the fourth and fifth embodiments, it is possible to effect clear writing on the respective blasted surfaces 34*a*-1 and 34'*a*-1 of the thus-recorded sheet 34 and 34' by means of a writing instrument such as a pencil or a ball-point pen.

The following is a description of still another modified form of heat-sensitive sheet usable in the fourth and fifth embodiments.

A specific feature of the heat-sensitive sheet of this modified form is that, in order to improve the bonding between the light-transmissive base sheets 34*a*, 34'*a* and the color forming heat-sensitive layers 34*b*, 34'*b*, respectively, the surface of each of the color forming heat-sensitive layers 34*b* and 34'*b* adhering to the light-transmissive base sheets 34*a* and 34'*a* is roughened by blasting, and the color forming heat-sensitive layers 34*b* and 34'*b* are respectively formed thereon by coating. In order that the light transmissions of the thus-blasted light-transmissive surfaces of the respective light-transmissive base sheets 34*a* and 34'*a* covered with the color forming heat-transmissive layers 34*b* 34'*b* be increased to a level above the light transmissions of the merely blasted light-transmissive base sheets 34*a* and 34'*a*, the components constituting the heat-sensitive layers 34*b* and 34'*b*, i.e., a dye, a developer and a binder are selected from the groups described previously in the fourth embodiment, and the thus-selected substances are coated over the respective base sheets 34*a* and 34'*a* to prepare the color forming heat-sensitive sheets 34 and 34'. If image recording is performed as described previously in the fourth and fifth embodiments using each of the prepared heat-sensitive sheets 34 and 34', clear and high-quality recording is enable owing to the effective use of flashlight without involving a risk that the color forming heat-sensitive layers 34*b* and 34'*b* may be removed from the base sheets 34*a* and 34'*a*, respectively.

As described above, the fourth and fifth preferred embodiments of the present invention accomplish a method of and an apparatus for easily recording an image by means of a simple, inexpensive, compact and light-weight apparatus.

A sixth preferred embodiment of the present invention and various modified formed of heat-sensitive sheet will be described below with reference to FIGS. 9A to 12. In the following description, like reference numerals are used to denote the like or corresponding elements relative to those in the above-described fourth to fifth embodiments.

Figure 9A:
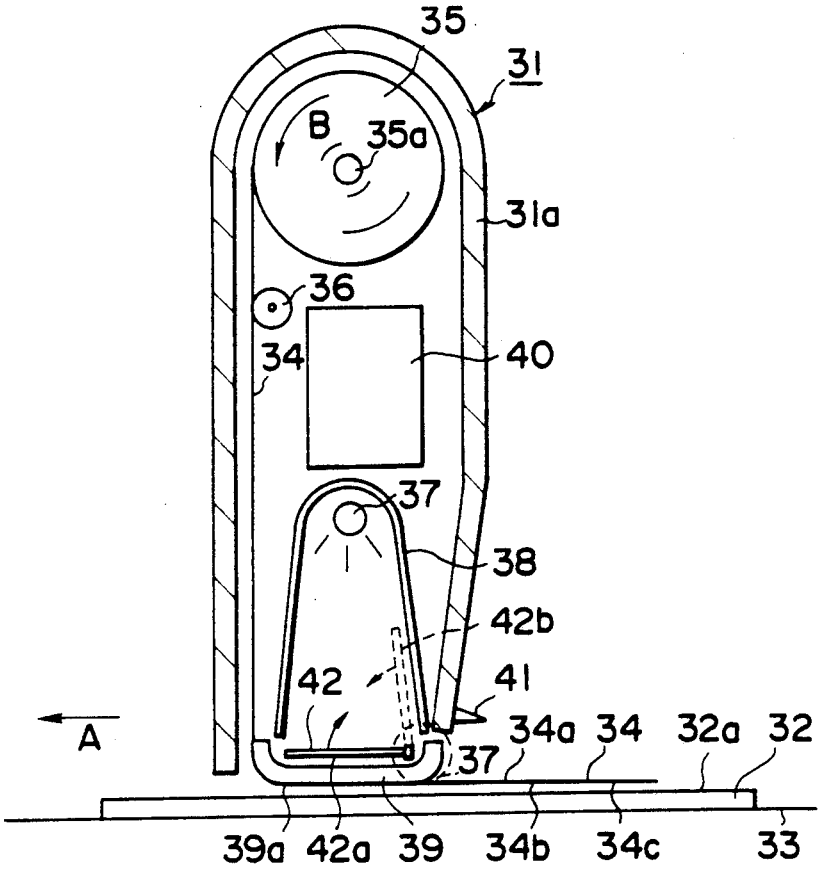
FIG. 9A is a diagrammatic, side elevational view showing, in cross section, a sixth preferred embodiment of a method of and an apparatus for recording an image in accordance with the present invention.
Figure 9B:
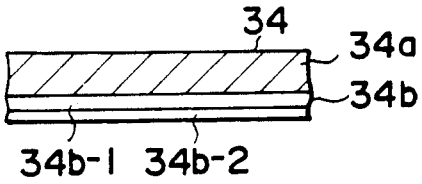
FIG. 9B is a fragmentary, cross-sectional view of a color forming heat-sensitive sheet taken in a direction along its thickness, the sheet being used in the recording method and the apparatus both of which constitute the sixth embodiment.
Figure 11:
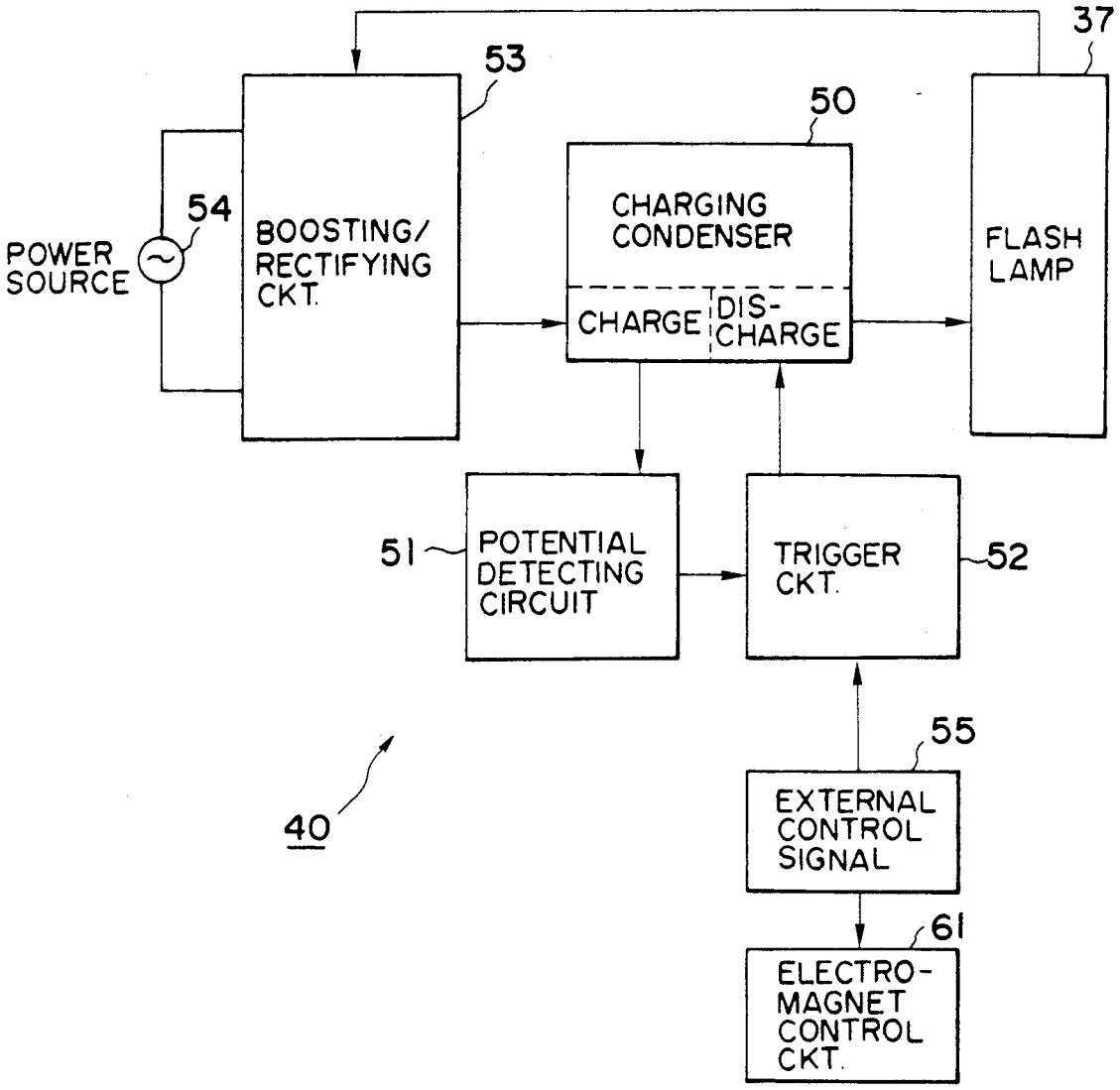
FIG. 11 is a block diagram of the apparatus used in the sixth and seventh preferred embodiments of the present invention.
Figure 12:
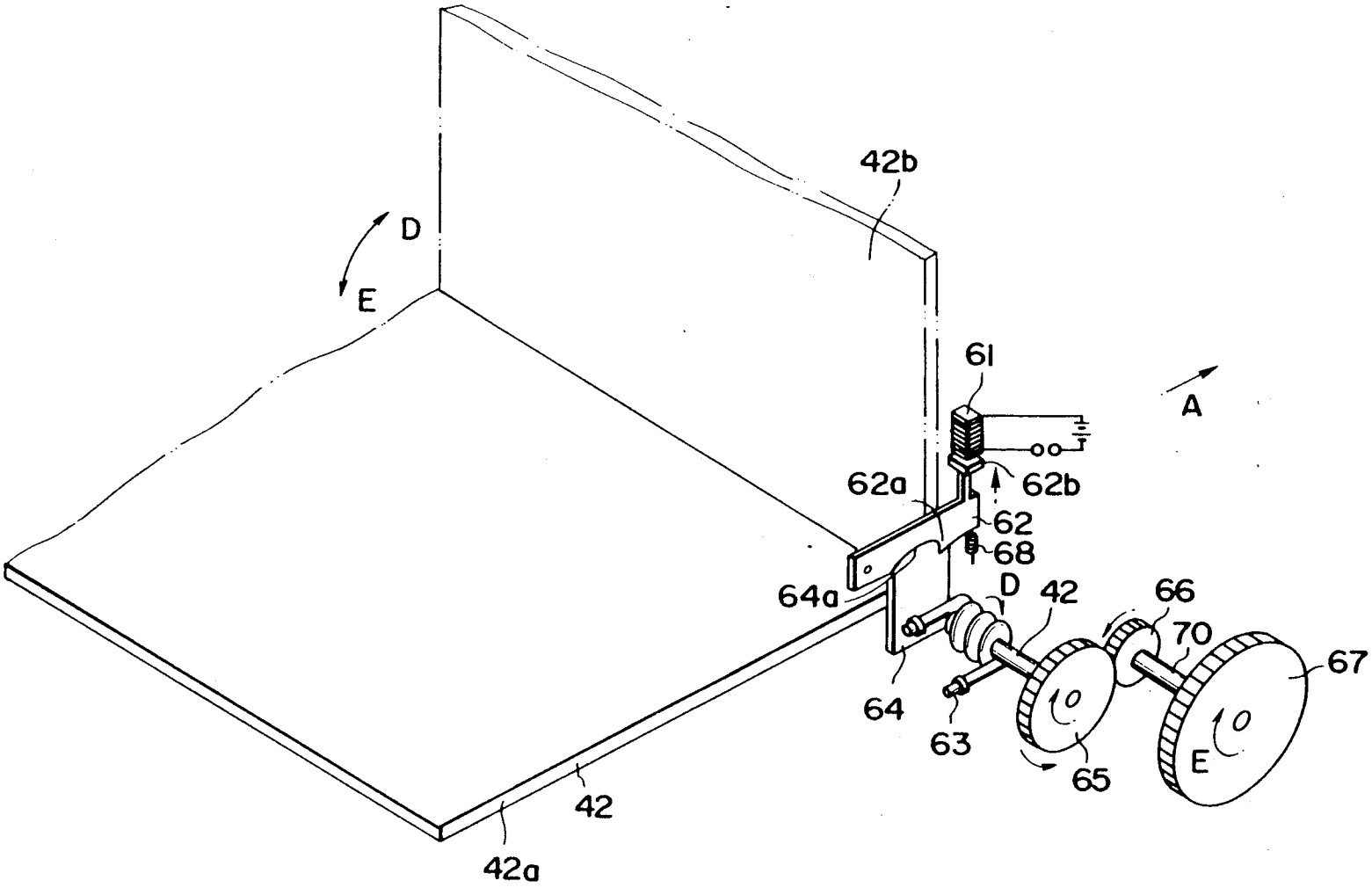
FIG. 12 is a diagrammatic, perspective view illustrating a drive mechanism for a filter used in the present invention.

The sixth embodiment will be described below with specific reference to FIGS. 9A, 9B, 11 and 12. FIG. 9A is a diagrammatic, side elevational view showing, in cross section, an image recording apparatus constituting the sixth embodiment of the present invention. FIG. 9B is a fragmentary, cross-sectional view of a color forming heat-sensitive sheet used in the sixth embodiment as viewed in a direction along its thickness in which the color forming heat-sensitive sheet is indicated at 34. In FIGS. 9A and 9B, a wavelength selecting filter 42 is incorporated so as to block light in a wavelength range of 500 mn or less, and the filter 42 is shown in FIG. 12.

The color forming heat-sensitive sheet 34 shown in FIG. 9B includes: the light-transmissive base sheet 34*a* made of transparent film having a thickness of about 3 to 300 μm, preferably, about 25 to 50 μm and composed of polyethyleneterephthalate, polyamideimide or the like, or translucent paper, such as tracing paper or so-called transparency, impregnated with paraffin or oil; and upper and lower layers coated over the light-transmissive base sheet 34*a* in the form of the color forming heat-sensitive layer 34*b* having a thickness of about 10 to 100 μm, preferably 20 to 70 μm. The lower layer is comprised of a developer layer 34*b*-1 including a binder of isobutylene-hydrophobic maleic acid copolymer and a salt dispersed therein which will be described later. The upper layer is comprised of a light-sensitive layer 34*b*-2 including a binder of stearic acid amide as well as a diazonium salt and a coupler both of which are dispersed therein. The diazonium and the coupler will be described later.

The term "color forming heat-sensitive layer" used herein is defined as a layer which normally exhibits no color but shows deep color by heating. The color forming heat-sensitive layer used in the sixth embodiment exhibits color at an elevated temperature to which the temperature of the original image portion is heated by illumination with flashlight in which 500 nm or less is blocked, that is, at temperatures of about 80° to 160° C. or about 10° C. lower than those (since the original image portion is colored, if it is exposed to light, the original image portion accumulate heat therein and its temperature is thus elevated).

In addition, in the sixth embodiment, optical fixation is enabled by using the color forming heat-sensitive layer 34*b* composed of a diazo color forming heat-sensitive substance of the type that is decomposed by photochemical reaction when exposed to light of 500 nm or less after color has been developed but does not exhibit color by heating.

To this end, the sixth embodiment utilizes a material used in a heat-development diazo copying system employing a heat-fusible basic salt.

The following diazonium salt is used:

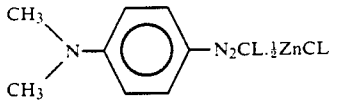

The following compound is also used:

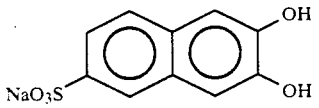

The above compound (hereinafter referred to as a "coupler") is used for constituting the light-sensitive layer **34*b*-2 in combination with the previously-mentioned diazonium salt and has a coupling property with respect to the diazonium salt. Also, the following heat-fusible basic salt constituting the developer layer 34*b*-1** is as follows:

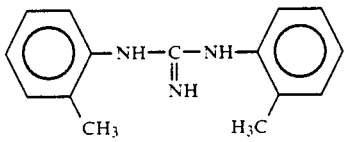

When such a color forming heat-sensitive sheet 34 is heated, the heat-fusible basic salt of the developer layer **34*b*-1 is melted by heat, and thus the diazonium salt and the coupler present in the photosensitive layer 34*b*-2 are exposed to a basic atmosphere to produce a coupling reaction, thereby generating diazo dye. Thus, the color forming heat-sensitive sheet 34 exhibit bluish purple. Also, when this heat-sensitive sheet 34 is illuminated by light of 500 nm or less, the diazonium salt is optically decomposed. In this state, the heat-sensitive sheet 34** no longer exhibits color even by heating. In this way, after a desired image has been clearily recorded by means of light in a wavelength range of 500mn or more, if the image is subjected to optical fixation using light in a wavelength range of 500 nm or less, it is possible to obtain an image which can be stably stored over an extended period of time.

In an image recording method constituting the sixth embodiment, while the color forming heat-sensitive sheet 34 is being brought into intimate contact with the copy original 32, flashlight is projected in the direction from the light-transmissive base sheet **34*a* to the copy original 32. Accordingly, the heat-sensitive sheet 34 provided with the developer layer 34*b*-1 and the photosensitive layer 34*b*-2 is preferably translucent, more preferably transparent. In order to satisfy such a characteristic, in addition to the previously-mentioned substances, the basic salt in the developer layer 34*b*-1 as well as the diazonium salt and the coupler in the photosensitive layer 34*b*-2** may be made of the following material. For example, the following type of diazonium salt may be used:

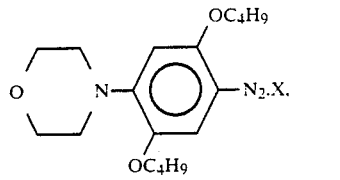

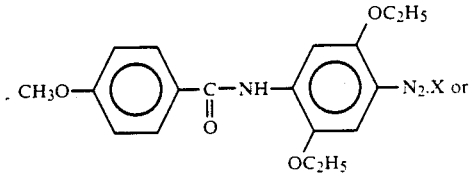

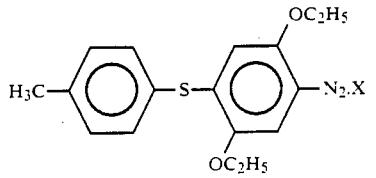

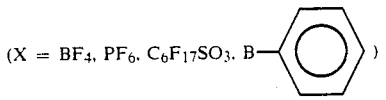

Also, the following compounds having a coupling characteristic may be used:

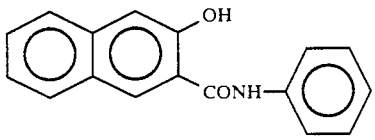

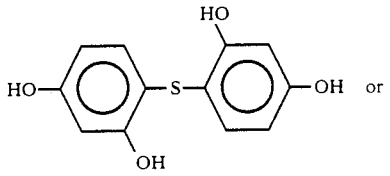

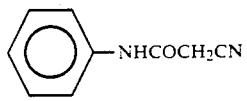

The following basic compounds are typically used:

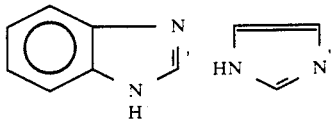

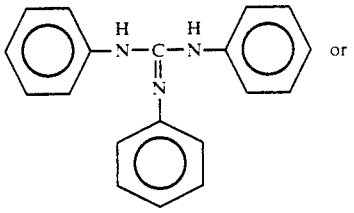

-continued

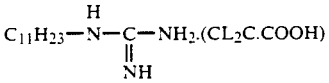

Also, if the following heat sensitizers are used, it is possible to improve sensitivity with respect to heat.

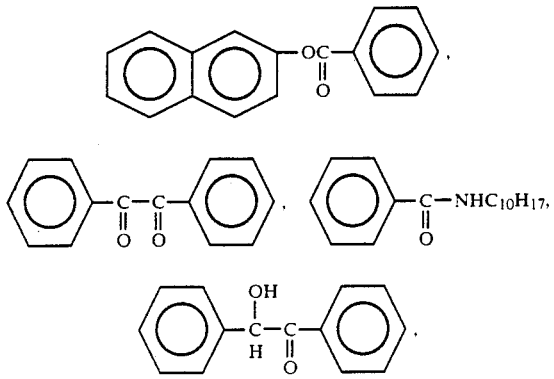

$C_{17}H_{35}CONH_2$ or $C_{17}H_{35}CONHCH_2OH$

The following is a description of the step of forming an colored image corresponding to the image of the copy original 32 on the color forming heat-sensitive layer 4b of the heat-sensitive sheet 34 having the above-described construction.

Referring to FIG. 9A, the color forming heat-sensitive sheet 34 is wound around the shaft 35a in the form of the sheet roll 35. The heat-sensitive sheet 34 is passed along the lower surface 39a of the pressing means 39 with the color forming heat-sensitive layer 34b of the former maintained in contact with the copy original 32, and then the leading end 34c of the sheet 34 is drawn out of the body 31. Then, the body 31 is laid on the copy original 32 such that the lower surface 39a of the pressing means 39 is positioned directly above the original image of the copy original 32 to be copied.

Subsequently, the operator presses the leading end 34c of the heat-sensitive sheet 34 against the copy original 32 by either hand while holding the body 31 in the other hand. In this state, while applying force acting to press the body 31 against the desk 33 so that the heat-sensitive sheet 34 is maintained in intimate contact with the copy original 32, the operator causes the body 31 to scan in the direction indicated by an arrow A of FIG. 9A. (FIG. 7 shows in perspective the manner in which the operator operates the body 31.) During this scan, each time the unit length of the heat-sensitive sheet 34 slightly smaller than the illumination coverage of the flashlight source 37 is fed, the previously described control means 40 causes the flashlight source 37 to instantaneously emit light so as to illuminate the copy original 32 from the surface of the heat-sensitive sheet 34 opposite to the color forming heat-sensitive layer 34b. In this state, the wavelength selecting filter 42 is placed at a block position indicated at 42a at which it serves to block light in a wavelength range of 500 nm or less, thereby preventing the photodecomposition of the diazonium salt in the light-sensitive layer 34b-2 of the color forming heat-sensitive sheet 34. Also, the light transmitted through the heat-sensitive sheet 34 is absorbed by an image portion of the copy original 32 (for example, black letters), and heat is thus generated in the image portion. The thus-generated heat acts upon the portion of the developer layer 34b-1 and the photosensitive layer 34b-2 of the heat-sensitive sheet 34 that corresponds to the image portion to cause it to produce color, thereby recording a colored image on the color forming heat-sensitive sheet 34.

Immediately thereafter, means as shown in FIG. 12 is used to cause the wavelength selecting filter 42 to move to a ready position indicated at 42b in FIG. 9A thereby instantaneously lighting the flashlight source 37. During this time, since the light in a wavelength range of 500 nm or less is not blocked, the diazonium salt in the light-sensitive layer 34b-2 is optically fixed by its photodecomposition. Since the quantity of light required for such optical fixation may be about one-tenth of that required for image recording and charging time for the flashlight source 37 is shortened, the process for the optical fixation is instantaneously completed immediately after image recording. Also, if the level of voltage applied to the flashlight source 37 is changed and the efficiency of emission of light in a short wavelength range is thereby increased, it is possible to further reduce the charging time.

After the desired image has been recorded on the color forming heat-sensitive sheet 34 in the above-described manner, the heat-sensitive sheet 34 is moved in the direction indicated by an arrow A of FIG. 9A. Subsequently, if image recording is performed in accordance with the same procedures as described above, it is possible to sequentially effect image recording.

Drive means for driving the wavelength selecting filter 47 will be described more specifically with reference to FIG. 12 with FIGS. 9A and 11.

As shown in FIG. 9A, the wavelength selecting filter 42 is disposed on the side of the pressing means 39 facing the flashlight source 37 for blocking light emitted from the flashlight source 37, the pressing means 39 being mounted to the body 31.

The wavelength selecting filter 42 is secured to a shaft 42c disposed at a predetermined location of the cover 31a for the body 31, and is arranged to swing between the block position 42a and the ready position 42b by the rotation of the shaft 42c.

A plate 62 and a gear 65 are attached to the shaft 42c, and a torsion spring 63 is loosely fitted onto the shaft 42c. The torsion spring 63 has one end secured to the cover 31a and the other end secured to the plate 64 provided with an engagement portion 64a. The plate 62 is pivotally supported at one end on the cover 31a via a pin and is urged at the other end by a pulling spring 68 disposed between the other end and the cover 31a. The plate 62 has a pawl 62a engagable with the engagement portion 64a of the plate 64, and is urged by the pulling spring 68 into engagement with the plate 64. The end portion of the plate 62 having the pulling spring 68 is provided with a magnetically attractable portion 62b. An electromagnet 61 is disposed on the cover 31a in face-to-face relationship with the magnetically attractable portion 62b, and the electromagnet 61 is controlled by the drive circuit 40 shown in FIG. 11 to attract the portion 62b.

The aforesaid gear 65 is meshed with a gear 66 fitted on a shaft 70. The gear 66 includes a one-way clutch so as to prevent the rotation in the direction of an arrow D from being transmitted to the shaft 70. A roller 67 is fitted onto the other end of the shaft 70 and has a surface made of a substance having a high coefficient of friction such as rubber. During the travelling of the body 31, the surface of the roller 67 is brought into frictional contact with the surface of the copy original 32, and this frictional contact causes rotation of the roller 67. This rotation in turn causes rotation of the shaft 42*c* via the gears 66 and 65.

The wavelength selecting filter 42 having the aforesaid arrangement is first located at the position indicated at 42*a*. Immediately after the flashlight source 37 has emitted light, the electromagnet 61 is energized. The energization of the electromagnet 61 attracts the magnetically attractable portion 62*b* of the plate 62 against the pulling spring 68 to cause rotation of the plate 62 about the pin thereby allowing the pawl 62*a* to disengage from the engagement portion 64*a* of the plate 64 and thus to release the engagement of the engagement portion 64*a*. Simultaneously with the disengagement of the engagement portion 64*a*, the electromagnet 61 is demagnetized. The plate 64 is rotated in the direction of the arrow D under the urging force of the torsion spring 63 to move the wavelength selecting filter 42 to the position indicated at 42*b*. At this time, the rotation in the direction of the arrow D is transmitted to the gear 66 through the gear 65, but it is not transmitted to the shaft 70 by the action of the one-way clutch incorporated in the gear 66. Also, after the wavelength selecting filter 42 has been moved to the ready position indicated at 42*b* and optical fixation has been performed, the body 31 is moved in preparation for the succeeding image recording. In this case, when the roller 67 is brought into frictional contact with the copy original 32 during movement of the body 31, the roller 67 is rotated in the direction of an arrow E of FIG. 12. The rotation of the roller 67 is transmitted to the shaft 42*c* through the gears 66 and 65 to cause the wavelength selecting filter 42 to swing in the direction of the arrow E and assume the position indicated at 42*a*. When the wavelength selecting filter 42 is stopped at the blocking position indicated at 42*a*, the engagement portion 64*a* of the plate 64 and the pawl 62*a* of the plate 62 are engaged with each other, and the plate 62 is caused to engage with the plate 64 under the urging force of the pulling spring 68. Thus, preparation for the succeeding image recording is completed. In the above-described manner, the position of the wavelength selecting filter 42 is changed in association with the progress of image recording.

In association with the unit displacement of the color forming heat-sensitive sheet 34 that is slightly smaller than the illumination coverage of the flashlight source 37, the flashlight source 37 is caused to flash to effect image recording and optical fixation. This operation is, for example, performed as follows. The guide roller 36 is arranged to be rotated in association with the feed of the heat-sensitive sheet 34. A detecting means (not shown) is used to detect this rotation, thereby detecting the displacement (length of feed) of the heat-sensitive sheet 43. The thus-obtained detection signal is supplied to the aforesaid control means 40, and, in response to the signal input, the flashlight source 37 emit light.

In this case, however, if the body 31 is made to scan excessively fast, the charging intervals of the flashlight source 37 become short correspondingly, and thus a proper period of charging time may not be obtained. To obviate this problem, for example, a clutch (not shown) may be attached to the central shaft 35*a* of the sheet roll 35 so as to limit the rotation of the sheet roll 35. With this arrangement, if the scanning speed of the body 31 is excessively fast with respect to the proper charging time of the flashlight source 37, the feed of the heat-sensitive sheet 34 can be limited by the clutch. In this case, an on-off signal for the clutch is transmitted to the trigger circuit 52 in the form of the external control signal 55 shown in FIG. 11; for example, the detection signal of the aforesaid detecting means, and thus the lighting of the flashlight source 37 and the control of feed of the heat-sensitive sheet 34 can be associated with each other by known control means via the trigger circuit 52. As shown in FIG. 11 by way of example, the charging capacitor 50 may be incorporated for lighting the flashlight source 37. The potential detecting circuit 51 detects the completion of charging of the capacitor 50, and the thus-obtained detection signal is transmitted to the trigger circuit 52.

On the other hand, upon commencement of image recording, the operator first draws the unit length of the heat-sensitive sheet 34 out of the body 31. When the aforesaid clutch stops rotation of the sheet roll 35, this sheet drawing operation is completed. Simultaneously, a signal representing the completion of drawing of the heat-sensitive sheet 34 is transmitted from the aforesaid detecting means to the trigger circuit 52. When the trigger circuit 52 receives both the signals representing the completion of charging and the completion of feed of the unit length of the heat-sensitive sheet 34, the trigger circuit 52 generates a trigger signal to cause discharge of the charging capacitor 50, thereby lighting the flashlight source 37. Immediately after this lighting, the electromagnet 61 is energized to cause movement of the wavelength selecting filter 42 from the block position indicated at 24*a* to the ready position indicated at 42*b*, thereby effecting optical fixation. Subsequently, the limiting control of feed of the heat-sensitive sheet 34 is cancelled, that is, the clutch (not shown) is disengaged, and the body 31 is caused to scan a distance equivalent to the unit length of the heat-sensitive sheet 34 and at the same time the charging capacitor 50 of the flashlight source 37 is electrically charged. In the same manner as described above, the flashlight source 37 is repeatedly caused to emit light in accordance with each length of feed of the heat-sensitive sheet 34. Incidentally, the boosting/rectifying circuit 53 is disposed so as to rectify the voltage from the power source 54 and then to supply the thus-rectified voltage to the charging capacitor 50.

Through the above-described process, the portion on which a desired image is recorded is cut off the heat-sensitive sheet 34 by the cutter 11, and this completes the image recording process.

As described above, the sixth preferred embodiment enables clear and high-quality analog recording by means of a remarkably simple, compact and light-weight apparatus.

The following is a description of another modified form of color forming heat-sensitive sheet usable in the sixth embodiment.

Figure 9C:
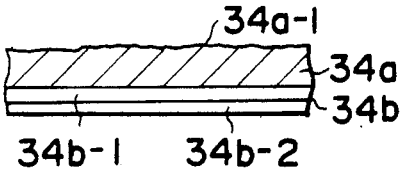
FIG. 9C is a view similar to FIG. 9B, but showing another modified form of color forming heat-sensitive sheet having one surface which is subjected to a conventional blasting treatment.
Figure 10A:
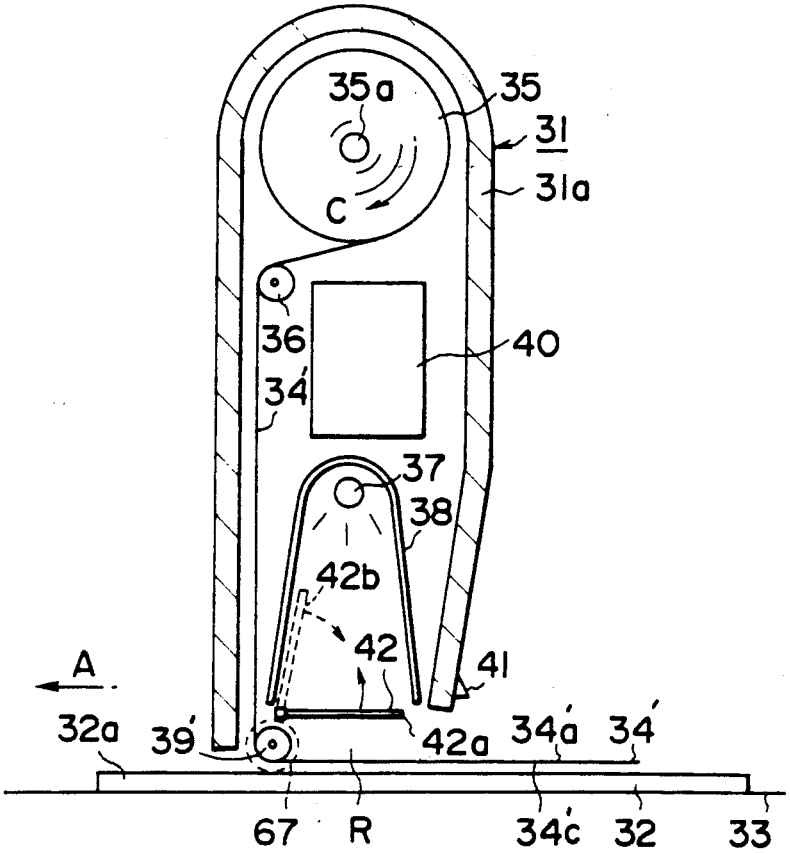
FIG. 10A is a diagrammatic, side elevational view showing, in cross section, a seventh preferred embodiment of a method of and an apparatus for recording an image in accordance with the present invention.
Figure 10B:
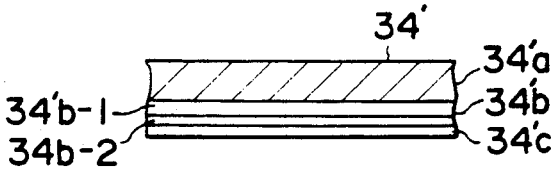
FIG. 10B is a fragmentary, cross-sectional view of a color forming heat-sensitive sheet taken in a direction along its thickness, the sheet being provided with an adhesive layer employed in the seventh preferred embodiment.
Figure 10C:
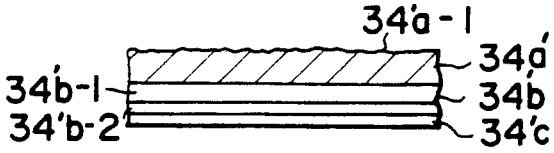
FIG. 10C is a view similar to FIG. 10B, but showing another modified form of color forming heat-sensitive sheet having an adhesive layer, the surface of which is subjected to a conventional blasting treatment.

Referring to FIGS. 9C and 10C, the respective light-transmissive base sheets 34*a* and 34*a*' of the heat-sensitive sheets 34 and 34' have the back surfaces 34*a*-1 and 34'*a*-1 which are worked through a blasting treatment so as to provide the maximum surface roughness of about 3 to 10 μm. Such a blasting treatment enables direct writing on the respective surfaces 34*a*-1 and 34'*a*-1 of the recorded sheet 34 and 34' by means of a writing instrument such as a pencil. It is to be noted that, even after recording has been performed by the methods depicted in the sixth embodiment, it is possible to effect clear writing on the respective blasted surfaces 34*a*-1 and 34'a-1 of the thus-recorded sheet 34 and 34' by means of a writing instrument such as a pencil or a ball-point pen.

In the above-described sixth embodiment, although the layer composed of diazonium salt and a coupler are separated from the layer of a basic compound, microcapsular diazonium salt together with a coupler and a basic compound may be dispersed in one layer.

The following is a description of still another modified form of color forming heat-sensitive sheet usable in the sixth embodiment.

The following type of color forming heat-sensitive sheet comprises one layer including microcapsules containing two kinds of diazonium salt as well as a coupler and a basic compound, with the microcapsules, the coupler and the basic compound being dispersed in the one layer. The coupler and the basic compound used in the sixth embodiment are the same as those of the previously described embodiments.

One kind of diazonium salt has the maximum absorption wavelength in the vicinity of a wavelength of 300 nm, suitably, in a wavelength range of 300 nm or less, and compounds including this kind of diazonium salt exhibit red. One example is as follows:

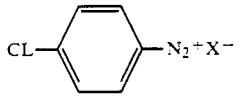

(X is CL, Br, $CLO_4$, $BF_4$ or the like)

Another kind of diazonium salt has the maximum absorption wavelength in the vicinity of 400 nm, and compounds including this kind of diazonium salt exhibit green. One example is as follows:

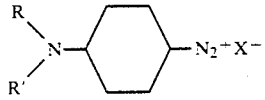

(R,R' is $CH_3$, $C_2H_5$, $C_3H_7$, 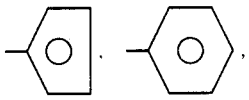

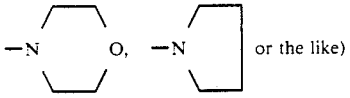

or the like)

(X is CL, Br, $CLO_4$, $BF_4$ or the like)

The following is a description of the image recording effected by a combination of a heat-sensitive sheet including these compounds and the recording apparatus shown in FIG. 9A.

A specific feature of the image recording method which is will be described later is that images each having different color can be obtained by selecting insertion or non-insertion of the wavelength selecting filter 42 in the optical path for an image recording operation. Therefore, no optical fixation is performed in this image recording method.

In a case where image recording is to be effected using the wavelength selecting filter 42 while blocking light in a wavelength range of 500 nm or less, two kinds of diazonium salt are not optically decomposed by exposure to light emitted from the flashlight source 37 but, as described previously, a portion corresponding to the image portion of the copy original 32 to be illuminated is heated to exhibit black (red+green).

On the other hand, in a case where exposure is effected without using the wavelength selecting filter 42, diazonium salt of the type that has the maximum absorption wavelength in the vicinity of 400 nm and that exhibits green by exposure to flash light is decomposed simultaneously with the exposure, and thus exhibits no color. However, diazonium salt of the type that has the maximum absorption wavelength in the vicinity of 300 nm is not optically decomposed by exposure to the emission of the flashlight source 37 because, as described above, the flashlight source 37 emits light in a wavelength range of 300 nm or more. Therefore, the portion corresponding to the image portion of the copy original 32 exihites red.

As described above, it is possible to selectively produce an image represented in desired color by determining the use or non-use of the wavelength selecting filter 42.

Also, a take-up mechanism for the color forming heat-sensitive sheet 34 may be incorporated in the body 31 so that the heat-sensitive sheet 34 can be fed back and forth between such a take-up mechanism and the sheet roll 35 to effect image recording twice. In this arrangement, first image recording is performed through the wavelength selecting filter 42, and second image recording is carried out without using the wavelength selecting filter 42. Thus, an image containing red and black can be achieved.

In this modified form, although a two-color image is produced by a combination of different types of diazonium salt, another combination of diazonium salt and a leuco dye may be utilized.

As described in detail above, in this modified form, it is possible to obtain recorded images which can be stored over an extended period of time by effecting image recording by selecting the wavelength of the flashlight source, and also two-color images can be achieved.

The following is a description of various modified forms of color forming heat-sensitive sheet usable in the respective embodiment shown in FIG. 6A and others. The following description will be performed with specific reference to FIGS. 13 to 16.

Each form of color forming heat-sensitive sheet which will be described later generally includes a base, a color forming heat-sensitive layer and an adhesive layer having removability in this order.

Figure 13:
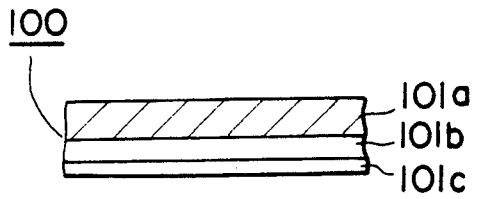
FIG. 13 is a fragmentary, cross-sectional view of another modified form of color forming heat-sensitive sheet taken in a direction along its thickness, the sheet adapted for the respective preferred embodiments of the invention.

Referring to FIG. 13, a color forming heat-sensitive sheet 100 includes a base sheet 101*a*, a color forming heat-sensitive layer 101*b* formed on the base sheet 101*a* and in addition an adhesive layer 101*c* formed on the layer 101*b*. The heated portion of the heat-sensitive layer 101*b* exhibits color. In a case where the heat-sensitive sheet 100 is to be used in combination with a method of illuminating the same from the base sheet 101*a* to the heat-sensitive layer 101*b*, the base sheet 101*a* is preferably of the light-transmissive type. For example, the base sheet 101*a* may be formed of transparent film made of polyethylene terephthalate, polyamide imede, tracing paper, translucent paper of the beated type that is produced by pressing a sheet made of short pulp (for example, so-called transparency), impregnated with paraffin or oil. The thickness of the base sheet 101*a* is preferably about 3 to 300 μm, more preferably about 25 to 50 μm.

The color forming heat-sensitive layer 101*b* is a layer which exhibites desired color by heating, and includes a binder containing a heat-sensitive color former. Of course, the heat-sensitive layer 101*b* is preferably of the light-transmissive type. The heat-sensitive color formers to be contained in the heat-sensitive layer 101*b* are listed below by way of example:

1) two-component color formers of the color forming dye type such as a combination of leuco dye referred to as "3, 3 (3', 6'-tetramethyldiaminofluorenyl)-6-dimethylaminophthalide and a developer referred to as "4, 4'-isopropylidenediphenyl (bisphenol A); and 2) combinations of various leuco dyes such as 3, 3-bis (p-dimethylaminophenyl) phthalide, 3-dimethylamino-6 methoxyfluorane, 3-phenyl-8'-methoxybenzoindolinospiropyran; and phenol compounds (developer) such as 4, 4'-isopropylidenediphenyl (bisphenol A), catecohol and resorcin.

The aforesaid heat-sensitive color former may be selected from the group consisting of compounds of the type that exhibits color in single form by thermal decomposition, such as indole derivatives, pyrroline derivatives, dithiocarbamic acid metal salt and nitrose compounds.

Also, a heat-sensitive color former of the type that includes a two-component substance composed of an electron donor and an electron acceptor is dispersed in a binder resin, and the thus-obtained mixture may be used for the color forming heat-sensitive layer 101*b*. In this case, the heat-sensitive layer 101*b* assumes a solid state at room temperature but its binder is melted into a liquid state by heating, and thus the electron donor and acceptor react with each other to produce color. For example, the aforesaid two-component substance may be selected from the group consisting of two-component color formers of the metal compound type such as: a mixture of long-chain fatty acid iron salt (secondary iron stearic, secondary iron myristate) and phenol substances (tannic acid, gallic acid and ammonium salicylate); a mixture of organic heavy metal salt (acetic acid, stearic acid, palmitic acid and other salts resulting from Ni, Co, Pb, Cu, Fe, Hg and Ag) and alkaline earth metal sulfide (CaS, SrS or BaS); and a mixture of heavy metal nitrate salt (Ag, Pb, Hg or Th) and a sulfur compound (Na-tetrathionate, sodium thiosulfate or thiourea). Such a heat-sensitive color former is dispersed in a binder composed of a thermoplastic resin such as polyvinyl butyral, thereby obtaining the color forming heat-sensitive layer 101*b*.

The binder constituting the color forming heat-sensitive layer 101*b* is selected from among various kinds of binder such as polyacrylic amide and methylcellulose.

The thickness of such a heat-sensitive layer 101*b* is preferably about 10 to 100 μm, more preferably about 20 to 70 μm. The color formation temperature of the heat-sensitive layer 101*b* is preferably substantially the same as the elevated temperature of the image portion of the copy original or a temperature about 10° C. lower than that temperature. The color formation temperature is defined as a temperature which allows the heat-sensitive layer 101*b* to form color by heating and the elevated temperature of the image portion of the copy original is defined as a temperature to which such an image portion is heated by exposure to emission of the flashlight source. More specifically, in using an image recording apparatus which will be described later, the elevated temperature of the original image portion reaches about 80° to 160° C. Accordingly, the color formation temperature of the color forming heat-sensitive layer 101*b* is preferably about 80° to 60° C., or a temperature about 10° C. lower than that temperature range.

The adhesive layer 101*c* has adhesiveness and removability. The term "removability" used herein is defined as a capability by which, after the heat-sensitive sheet used in the respective embodiments has adhered to a given object via the adhesive layer 101*c*, the heat-sensitive sheet can be readily removed from the object without involving the phenomenon of an adhesive sticking to the same or any fog formed on the same. In addition, since the adhesive layer 101*c* has such removability, it repeatedly adheres to and is removed from an object.

The adhesive layer 101*c* having such removability may be made of known type of adhesive. For example, a spray type paste (3M Company -55) composed of 10wt% acrylic rubber, 65wt% 1. 1. 1 trichloroethane and 25% LPG may be applied by spraying over the color forming layer 101*b*. The thickness of the adhesive layer 101*c* is preferably about 5 to 10 μm.

In addition, the following mixtures may be used;

1) copolymer including 81.5 weight parts of acrylic acid 2-ethylhexyl, 10.0 weight parts of acrylic acid butyl, 5.0 weight parts of vinyl acetate and 3.5 weight parts of hydroxymethyl diacetone acrylic amide;

2) a mixture including copolymer emulsion and ethylene glycol glycidyl ether at a weight ratio of 100 : 3, the copolymer emulsion including 20.0 weight parts of acrylic acid 2-ethylhexyl, 75.0 weight parts of methacrylic acid 2-ethylexyl and 5.0 weight parts of methacrylic acid tert-butylaminoethyl; or 3) a mixture including copolymer emulsion and inorganic metal salt at a weight ratio of 100 : 5, the copolymer emulsion including 90.0 weight parts of acrylic acid 2-ethylhexyl, 2.0 weight parts of acrylic acid methyl and 8.0 weight parts of isobutoxymethyl acrylic amide.

Figure 14:
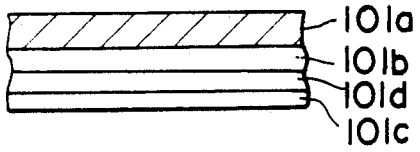
FIG. 14 is a view similar to FIG. 13, but showing another modified form of color forming heat-sensitive sheet adapted for the respective preferred embodiments.

As shown in FIG. 14, in order to prevent color change and decolorization from occurring in a colored image portion under the influence of the components contained in the adhesive layer 101*c*, a protective layer 101*d* may be formed between the color forming layer 101*b* and the adhesive layer 101*c*. The protective layer 101*d* may be formed, for example, of a water-soluble polymer such as polyvinyl alcohol, hydroxy ethyl cellulose or methyl cellulose. The thickness of the protective layer 101*d* is preferably about 1 to 10 μm in terms of its heat conductivity.

Figure 15:
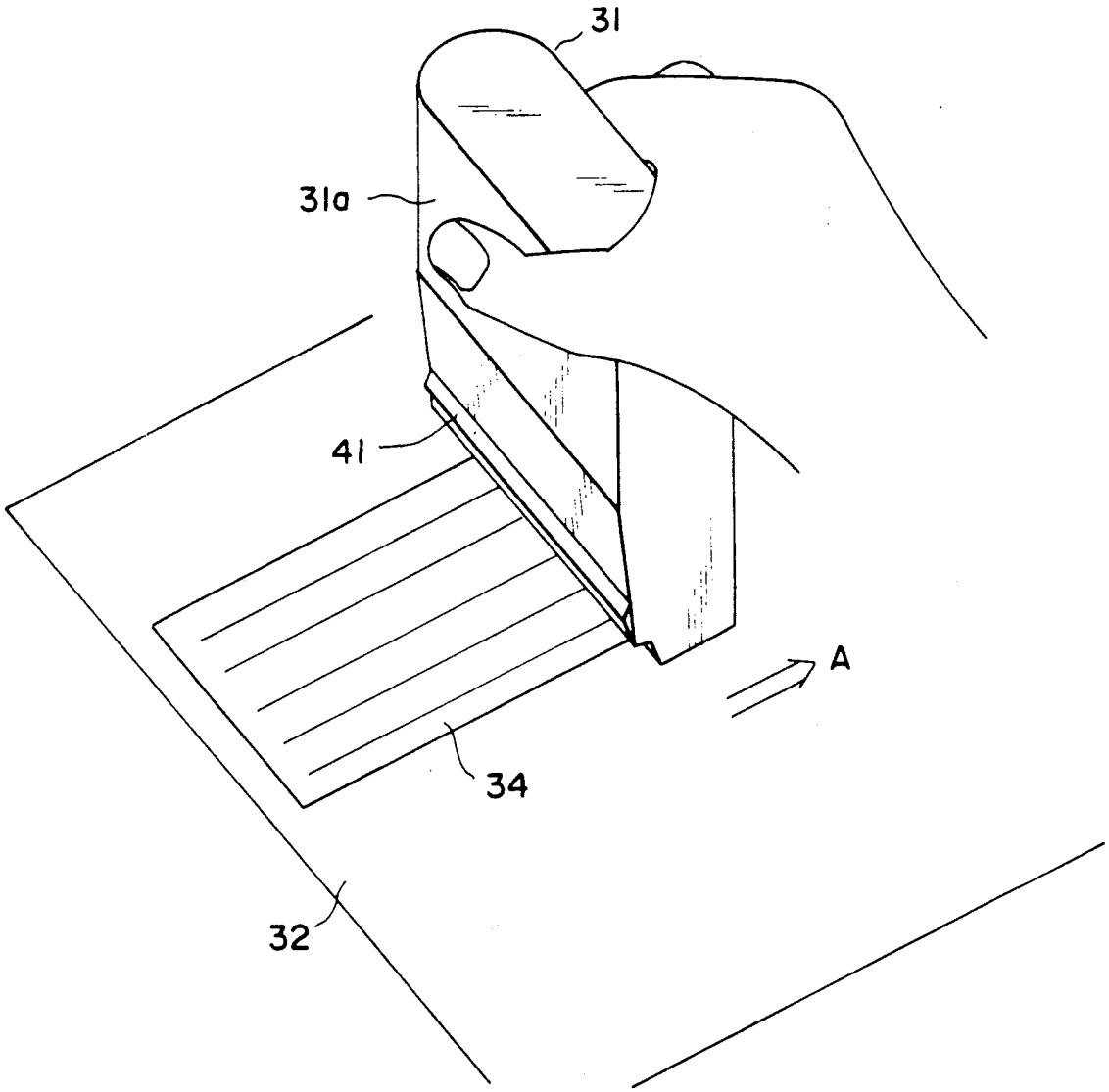
FIG. 15 is an illustration showing, in perspective, the manner in which image recording is performed using the image recording apparatus shown in FIG. 6A.

Image recording may be effected as in the case of the embodiment shown in FIG. 6A. At the time of image recording, the color forming heat-sensitive sheet 100 passes by the pressing roller 39', and the adhesive layer 101*c* comes into contact with the copy original 32 placed on the desk 33. Subsequently, the pressing roller 39' is held, against a desired copy start portion of the copy original 32 to be copied, and thus the adhesive layer 101*c* of the heat-sensitive sheet 100 is pressed against the copy original 32. Then, while applying force acting to press the image recording apparatus against the copy original 32 as shown in FIG. 15, the operator causes the apparatus to travel in the direction indicated by an arrow A of FIG. 15. As the body 31 of the apparatus travels, the sheet roll 35 is rotated in the direction of the arrow C to cause feed of the color forming heat-sensitive sheet 100.

Figure 16:
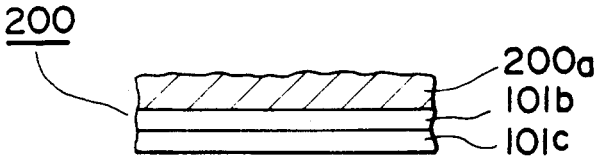
FIG. 16 is a view similar to FIG. 13, but showing still another modified form of color forming heat-sensitive sheet having one surface which is subjected to a conventional blasting treatment.

Referring further to FIG. 16, a color forming heat-sensitive sheet 200 includes a base sheet 200*a* having a back surface (the surface of the base sheet 200*a* opposite to the surface having the color forming heat-sensitive layer 101*b*) which is roughened by a blasting treatment. The remaining construction of the sheet 200 is the same as the heat-sensitive sheet 100 shown in FIG. 13. The blasting treatment is preferably effected so that the maximum surface roughness may be about 3 to 10 μm from the viewpoint of transmission factor.

The roughening of the back surface of the base sheet 200 enables direct writing on the base sheet 200*a* of the recorded color forming heat-sensitive sheet 200 of the present invention by means of a writing instrument such as a pencil.

As in the case of the heat-sensitive sheet shown in FIG. 14, it is also possible to provide the protective layer 101*a* between the color forming layer 101*b* and the adhesive layer 101*c* of the color forming heat-sensitive sheet 200 shown in FIG. 16.

Also, in order to improve the adhesive strength between the base sheet 200*a* and the color forming layer 101*b*, the surface of the base sheet 200*a* adjacent to the color forming layer 101*b* may is roughened by a blasting treatment, and thereafter color forming heat-sensitive layer 101*b* could be formed on the roughened surface.

Even if the surface of the base sheet 200*a* adjacent to the color forming layer 101*b* is subjected to a blasting treatment, since the color forming heat-sensitive substance is formed over the roughened surface, the resultant transmission factor is substantially the same as the base sheet which is subjected to no blasting treatment.

If the above-described color forming heat-sensitive sheet is used in the respective embodiments, it is possible to accomplish analog recording of a clear, uniform and high-quality image by means of a remarkably compact and light-weight apparatus.

Also, since the above-described color forming heat-sensitive sheet has an adhesive layer thereon, it is possible to positively bring the heat-sensitive sheet into intimate contact with a copy original. Therefore, since heat conductivity from the copy original to the heat-sensitive sheet is improved, a clear and uniform image can be recorded.

In addition, presence of such an adhesive layer enables an operator to operate the image recording apparatus so that the apparatus can be moved straight by either hand.

The following is a description of several examples of the color forming heat-sensitive sheets in accordance with the present invention.

EXAMPLE 1

A color forming heat-sensitive sheet was prepared by using a heat-sensitive color former and a developer. The heat-sensitive color former was a leuco dye referred to as "3, 3 (3', 6'-tetramethyldiaminofluorenyl)-6-dimethylaminophthalide (manufactured by Yamamoto Chemical Synthesization Co., Ltd.) and the developer was "4, 4'-isopropylidenediphenyl (bisphenol A).

More specifically, the heat-sensitive color former was mixed with the developer at a weight ratio of 1 : 3, and the thus-obtained mixture was dispersed in a binder composed of polyacrylic amide in an amount equivalent to about 10 percent by weight and about 2 wt.% stearic acid amide as a sensitizer was dispersed in the binder. The thus-prepared mixture was coated over 25-μm-thick PET film (the light-transmissive base sheet 101*b*) to form a color forming heat-sensitive layer having a thickness of about 50 μm.

The thus-obtained color forming heat-sensitive layer was coated by spraying with a spray type paste (3M Company - 55) composed of 10% acrylic rubber, 65% 1 . 1 . 1 trichloroethane and 25% LPG, and thus an adhesive layer having a thickness of about 7 μm was formed thereover. In consequence, the color forming heat-sensitive sheet 101*b* having a width of 45 mm was produced Such a heat-sensitive sheet 101*b* was colorless (translucent) at room temperature but exhibited deep green in a temperature range of about 100° to 120° C.

The thus-produced color forming heat-sensitive sheet was wound in the form of a roll, and image recording was effected by means of the recording apparatus shown in FIG. 6A and in accordance with the procedure shown in FIG. 15.

In consequence, the color forming heat-sensitive sheet used with the presently preferred embodiment exhibited deep green so that a clear image was recorded.

Incidentally, a copy original containing black letters was used and the illumination energy of the flash lamp of the recording apparatus was 5.1 J/cm$^2$. Thus, the illumination energy was about 4 J/cm$^2$ on the surface of the copy original and the temperature of the printed portion of the copy original was about 130° C.

EXAMPLE 2

A transparent polymeric protective layer was formed between a color forming heat-sensitive layer and an adhesive layer. The color forming heat-sensitive layer and the adhesive layer were the same as those used in Example 1.

10 wt.% polyvinyl alcohol was mixed with water, and the thus-obtained mixture was uniformly coated over the color forming heat-sensitive layer to form the polymeric protective layer having a thickness of about 5 μm.

Image recording was performed by using the thus-prepared color forming heat-sensitive sheet and in accordance with Example 1. The resultant recorded image was clear. In the color forming heat-sensitive sheet, the protective layer had the capability to prevent the solvent of the adhesive layer from penetrating the color forming heat-sensitive layer, thereby inhibiting the occurrence of color change and decolorization of the color forming heat-sensitive layer. Accordingly, the color forming heat-sensitive sheet having the protective layer was suitable for storage over a long period of time.

It is to be noted that presence of the protective layer does not influence the heat conductivity of the sheet.

As described above, the present invention provides a method of and an apparatus for recording a clear image both of which are capable of recording a clear image by means of a simple mechanism.

What we claimed is:

1. A method for recording an image onto a recording medium, said method utilizing a body having incorporated therein a heat-sensitive sheet consisting of a heat-fusible supercooled substance layer on a light-transmissive base sheet, said method comprising the steps of:

positioning said body over an original image surface to be recorded;

bringing the heat-fusible supercooled substance layer of said heat-sensitive sheet into contact with the original image surface by extracting said heat-sensitive sheet from an accommodating section within said body by means of an extracting force generated by movement of said body;

providing a source of light which is a flashlight;

intermittently projecting light from said source of light through the heat-sensitive sheet and onto a predetermined area of the original image surface, said light projection taking place from the light-transmissive base sheet side of said heat-sensitive sheet, thereby forming an adhesive area of said heat-fusible supercooled substance layer corresponding to an original image portion of said original image surface form heat generated by the original image portion after absorbing light emitted from said source of light;

peeling said heat-sensitive sheet from said original image surface after forming the adhesive area of said heat-fusible supercooled substance layer;

positioning the body onto the recording medium while adhesivity of said adhesive area remains effective, thereby bringing the heat-fusible supercooled substance layer of said heat-sensitive sheet into contact with the recording medium; and transferring said adhesive area to the recording medium by peeling the heat-sensitive sheet from said recording medium by moving said body across said recording medium thereby transferring said adhesive area to said recording medium and recording said image onto said recording medium.

2. The method according to claim 1, wherein said source of light is a Xenon lamp.

3. The method according to Claim 1, wherein said heat-fusible supercooled substance layer includes a heat-sensitive color former.

4. The method according to Claim 1, wherein said light-transmissive sheet is transparent film made of polyethylene terephthalate or polyamide imide.

5. A method according to claim 1, wherein said heat-fusible supercooled substance is a plasticizer.

6. A method according to claim 5, wherein said plasticizer is selected from the group consisting of N-cyclohexyl-p-toluenesulfonamide, N-ethyl-p-toluenesulfonamide, and dicyclohexylphthalate.

7. A method according to claim 1, wherein said heat-fusible supercooled substance is benzotriazole.

8. A method according to claim 1, wherein said heat-fusible supercooled substance is acetanilide.

9. A method according to claim 1, wherein said heat-fusible supercooled substance is mixed with a heat-fusible binder selected from the group consisting of a polyamide resin, a polyacrylic resin, or a polymeric thermoplastic resin, or natural or synthetic wax, and is coated on said light-transmissive base sheet as ink having supercooling on characteristics.

* * * * *

UNITED STATES PATENT AND TRADEMARK OFFICE

CERTIFICATE OF CORRECTION

PATENT NO. : 5,049,472

DATED : September 17, 1991

INVENTOR(S) : Nagao Hosono et al

It is certified that error appears in the above-indentified patent and that said Letters Patent is hereby corrected as shown below: On the title page:

AT [56] REFERENCES CITED

Foreign Patent Documents, "60-126632 4/1985 Japan" should read --60-126632 7/1985 Japan--.

COLUMN 1

Line 55, "an" (second occurrence) should read --a--.

COLUMN 9

Line 46, "week" should read --weak--.
Line 53, "-NO-" should read -- $-NO_2-$ --.
Line 54, "$_2$or" should read --or--.

COLUMN 10

Line 64, "mixtures" should read --mixtures.--.
Line 68, "heating" should read --heating.--.

COLUMN 15

Line 25, "cause" should read --caused--.

COLUMN 17

Line 64, "enable" should read --enabled--.

COLUMN 21

Line 27, "an" should read --a--.

UNITED STATES PATENT AND TRADEMARK OFFICE

CERTIFICATE OF CORRECTION

PATENT NO. : 5,049,472

DATED : September 17, 1991

INVENTOR(S) : Nagao Hosono et al

It is certified that error appears in the above-indentified patent and that said Letters Patent is hereby corrected as shown below:

COLUMN 24

Line 31, "24a" should read --42a--.

COLUMN 25

Line 59, "is" (first occurrence) should be deleted.

COLUMN 26

Line 18, "exihites" should read --exhibits--.

COLUMN 27

Line 4, "exhibites" should read --exhibits--.

COLUMN 28

Line 4, "60°C.," should read --160°C.,--.

COLUMN 30

Line 9, "produced" should read --produced.--.
Line 57, "claimed" should read --claim--.

COLUMN 31

Line 13, "form" should read --from--.

UNITED STATES PATENT AND TRADEMARK OFFICE

CERTIFICATE OF CORRECTION

PATENT NO. : 5,049,472

DATED : September 17, 1991

INVENTOR(S) : NAGAO HOSONO ET AL

It is certified that error appears in the above-indentified patent and that said Letters Patent is hereby corrected as shown below:

COLUMN 32

Line 27, "on" should be deleted.

Signed and Sealed this

Fourteenth Day of September, 1993

Bruce Lehman

*Attest:*

BRUCE LEHMAN

*Attesting Officer*

*Commissioner of Patents and Trademarks*